US009869090B2

(12) United States Patent
Wilson

(10) Patent No.: US 9,869,090 B2
(45) Date of Patent: Jan. 16, 2018

(54) CORRUGATED METAL PLATE AND OVERHEAD STRUCTURE INCORPORATING SAME

(75) Inventor: Michael W. Wilson, Sackville (CA)

(73) Assignee: Atlantic Industries Limited (CA)

( * ) Notice: Subject to any disclaimer, the term of this patent is extended or adjusted under 35 U.S.C. 154(b) by 0 days.

(21) Appl. No.: 14/238,331

(22) PCT Filed: Aug. 10, 2012

(86) PCT No.: PCT/CA2012/000752
§ 371 (c)(1),
(2), (4) Date: Jun. 26, 2014

(87) PCT Pub. No.: WO2013/023275
PCT Pub. Date: Feb. 21, 2013

(65) Prior Publication Data

US 2014/0305066 A1 Oct. 16, 2014

Related U.S. Application Data

(60) Provisional application No. 61/594,367, filed on Feb. 2, 2012, provisional application No. 61/523,026, filed on Aug. 12, 2011.

(51) Int. Cl.
*E04C 2/38* (2006.01)
*E04B 1/32* (2006.01)
(Continued)

(52) U.S. Cl.
CPC ..... *E04C 2/38* (2013.01); *E01F 5/005* (2013.01); *E04B 1/32* (2013.01); *E04C 2/08* (2013.01);
(Continued)

(58) Field of Classification Search
CPC . E04C 2/322; E04C 2/38; E04C 2/328; E21D 11/385; E04B 2001/327; E04B 2001/3288; E04B 2001/3276; E04B 1/32
(Continued)

(56) References Cited

U.S. PATENT DOCUMENTS 997,383 A 7/1911 Foster
2,015,102 A * 9/1935 Doig ..... E21D 11/10 405/152

(Continued)

FOREIGN PATENT DOCUMENTS

| | | |
|---|---|---|
| KR | 20120021975 | 3/2012 |
| WO | 9747825 | 12/1997 |
| WO | 2008104075 | 9/2008 |

OTHER PUBLICATIONS

PCT International Search Report and Written Opinion in PCT/CA2012/000752, filed Aug. 10, 2012, dated Nov. 8, 2012.

*Primary Examiner* — Andrew J Triggs
(74) *Attorney, Agent, or Firm* — Barnes & Thornburg LLP

(57) ABSTRACT

A corrugated metal plate comprises a plate configured to define a series of crests and troughs, where the plate has longitudinal edges extending parallel to longitudinal axes of the crests and the troughs and transverse edges extending orthogonally to the longitudinal axes of the crests and the troughs. The corrugated metal plate further comprises at least one of: at least one longitudinal flange extending from each longitudinal edge, and at least one transverse flange extending from each transverse edge.

33 Claims, 37 Drawing Sheets

(51) Int. Cl.
*E01F 5/00* (2006.01)
*E04C 2/08* (2006.01)
*E04C 2/32* (2006.01)

(52) U.S. Cl.
CPC ..... *E04C 2/322* (2013.01); *E04B 2001/3276* (2013.01); *Y10T 428/12354* (2015.01)

(58) Field of Classification Search
USPC ..... 52/783.11, 783.14
See application file for complete search history.

(56) References Cited

U.S. PATENT DOCUMENTS 2,160,342 A * 5/1939 Ribble ..... E21D 11/385 405/152
2,536,759 A * 1/1951 Martin et al. ..... 405/153
3,859,802 A * 1/1975 Platner ..... E21D 11/15 405/152
4,099,359 A * 7/1978 Sivachenko ..... E01D 19/125 405/284
4,186,541 A * 2/1980 Sivachenko ..... E01D 19/02 52/630
4,273,836 A 6/1981 Campbell et al.
4,736,566 A * 4/1988 Krotsch ..... 52/783.14
5,233,799 A 8/1993 Abukawa
5,326,191 A * 7/1994 Wilson ..... E01F 5/005 285/903
6,378,261 B1 * 4/2002 Agsten ..... 52/426
7,415,806 B2 * 8/2008 Davidson ..... 52/426
8,418,424 B2 * 4/2013 Davis et al. ..... 52/630
8,726,605 B2 * 5/2014 Davis et al. ..... 52/630
2002/0076280 A1 6/2002 Semotiuk et al.
2003/0143028 A1 * 7/2003 Wilson ..... E01F 5/005 405/124
2010/0126093 A1 * 5/2010 Davis et al. ..... 52/283
2014/0305066 A1 * 10/2014 Wilson ..... 52/643

* cited by examiner

CORRUGATED METAL PLATE AND OVERHEAD STRUCTURE INCORPORATING SAME

RELATED APPLICATIONS

This patent application is a U.S. nationalization under 35 USC §371 of International Application No. PCT/CA 2012/000752, filed Aug. 10, 2012, which claims priority to US Provisional Patent Application No. 61/594,367, filed Feb. 2, 2012 and US Provisional Patent Application No. 61/523,026, filed Aug. 12, 2011. The disclosures set forth in the referenced applications are incorporated herein by reference in their entireties.

FIELD OF THE INVENTION

The present invention generally relates to overhead structures and in particular, to a corrugated metal plate and to an overhead structure incorporating the same.

BACKGROUND OF THE INVENTION

As rural and urban infrastructure continues to age and develop, there is a continual demand for cost-effective technologies relating to the construction and maintenance of highways, railways and the like. Often unappreciated but vitally important to the construction of such infrastructure is the underpass system. Underpass systems are typically designed to carry not only dead loads, but also live loads. While some of the most impressive underpass systems are used in mining or forestry applications where spans can exceed twenty (20) meters, they are also very common in regular highway construction to allow passage of railway, watercourses or other vehicular/pedestrian traffic. While concrete structures have been regularly employed for these purposes, such concrete structures are very expensive to install, are cost prohibitive in remote areas, and are subject to strength weakening due to corrosion of the reinforcing metal, thereby requiring ongoing repair and limiting their use in certain environments.

In the field of overhead structures, such as for example but not limited to box culverts, circular and ovoid culverts, arch-type structures, encased concrete structures and other similar structures that make use of corrugated metal plate, there have been significant advances. For example, U.S. Pat. No. 5,118,218 to Musser et al. discloses a corrugated box culvert constructed from reinforced corrugated steel or aluminum sheets having very deep corrugations and generally having a uniform bending moment profile for the whole length of the culvert. By using significant material on the crown portions as well as on the haunch portions of the box culvert, significant loads can be carried by the box culvert. Ovoid and circular culvert structures have been generally described in U.K. Patent Application No. 2,140,848.

U.S. Pat. No. 5,326,191 to Wilson et al. discloses a reinforced metal box culvert having a standard crown, opposing sides and opposite curved haunches. The culvert is characterized in having continuous corrugated metal sheet reinforcement secured to at least the crown of the culvert, and extends the length of the culvert which is effective in supporting the load. The corrugated reinforcement has a profile which abuts the crown corrugations with the troughs of the reinforcement being secured to the crests of the corrugated crown. The corrugated reinforcement sheet has a curvature complementary to the corrugated crown to facilitate securement. The continuous reinforcement, as secured to the culvert in an uninterrupted manner, provides an optimum load carrying capacity for selected extent of reinforcement provided by the reinforcement metal sheets.

U.S. Pat. No. 5,833,394 to McCavour et al. discloses a composite concrete reinforced corrugated metal arch-type structure comprising a first set of shaped corrugated metal plates interconnected in a manner to define a base arch structure with the corrugations extending transversely of the longitudinal length of the arch, and a second series of shaped corrugated metal plates interconnected in a manner to overlay the first set of interconnected plates of the base arch. The second series of plates has at least one corrugation extending transversely of the longitudinal length of the arch, with the troughs of the corrugations of the second series of plates secured to the crests of the first set of plates. The interconnected series of second plates and the first set of plates define individual, transversely extending, enclosed continuous cavities filled with concrete to define an interface of the concrete enclosed by the metal interior surfaces of the second series of crests and first set of troughs. The interior surfaces of the cavities for each of the first and second plates have means for providing a shear bond at the concrete-metal interface to provide individual curved beams transversing the arch, whereby the structure provides positive and negative bending resistance and combined bending and axial load resistance to superimposed loads.

In some prior art overhead structures, adjacent corrugated metal plates are secured by overlapping circumferential edges of the corrugated metal plates so as to align holes therein, and then passing a fastener such as a bolt through each pair of aligned holes. As will be appreciated, this approach is cumbersome as two or more individuals are typically required to affix each bolt to the structure. Additionally, the axial strength of prior art overhead structures is generally a function of the shear strength of the bolts securing the overlapping portions of the plates.

Other approaches for securing adjacent corrugated metal plates have been described. For example, the publication entitled "Tunnel Liner Plate" by Armtec of Guelph, Ontario, Canada, discloses a steel tunnel liner plate. The liner plate forms part of a corrugated steel, two-flange sectional lining system designed for use primarily in soft-ground tunneling.

U.S. Pat. No. 4,650,369 to Thomas et al. discloses a low headroom culvert wherein a series of shallow arch-shaped flat metallic sections are overlappingly secured together. Torsion and buckle resistant reinforcing cross ribbing elements are affixed to the exterior culvert sections at selected points along the culvert to form girder-like beams. The culvert comprises crown and haunch ribs spliced or joined to each other by means of a bolt fastener and nut assembly. The bottom base flanges of the various haunch and crown rib beam segments are secured directly to the outside surfaces of the culvert sections.

U.S. Pat. No. 4,958,476 to Kotter discloses an architectural cover panel system of individually adaptive panels for covering structural support members of an underlying structure such as girders. An individual adaptive panel includes a sheet of flexible material having a generally convex cross-section and is provided with corrugations oriented perpendicular to the longitudinal axis of the panel. In one preferred embodiment the convex panel is provided with edged portions attached to the lateral sides of the panel. The edge portions are similarly provided with corrugations oriented parallel to and intersecting or merging into the corrugations of the convex panel portion.

U.S. Pat. No. 7,493,729 to Semmes discloses a commercial rooftop enclosure that utilizes a roof and wall panel design incorporated with structurally bent rails connecting panel assemblies to each other and to a corrugated panel steel base. The enclosure is formed into a torsion box style building wherein the strength of the enclosure is derived from its overall "unibody" style construction. With this design the rooftop enclosure purports to offer a lower overall profile, reduced weight and increased structural strength over its conventional counterparts.

When overhead structures fabricated of corrugated metal plates are used in the presence of fluids, there may be seepage or leakage of the fluids through joints of the structures. Improvements are generally desired.

It is therefore an object at least to provide a novel corrugated metal plate and an overhead structure incorporating the same.

SUMMARY OF THE INVENTION

Accordingly, in one aspect there is provided a corrugated metal plate comprising: a plate configured to define a series of crests and troughs, the plate having longitudinal edges extending parallel to longitudinal axes of the crests and the troughs and transverse edges extending orthogonally to the longitudinal axes of the crests and the troughs; and at least one of: at least one longitudinal flange extending from each longitudinal edge, and at least one transverse flange extending from each transverse edge.

Each of the at least one transverse flange may comprise a first flange portion and a second flange portion. Each first flange portion may have an upturned orientation relative to the plate and each second flange portion may have a downturned orientation relative to the plate.

Each of the at least one longitudinal flange may be generally centered on a crest or a trough.

The crests and troughs of adjacent plates may be generally contiguous when the longitudinal flanges of the adjacent plates abut.

One or more of each of the at least one longitudinal flange and each of the at least one transverse flange may comprise a plurality of apertures for receiving fasteners.

The corrugated metal plate may be curved in at least one of a longitudinal direction and a transverse direction.

Each of the at least one transverse flange may extend non-orthogonally from the plate.

The corrugated metal plate may further comprise gussets adjoining each of the at least one transverse flange to the plate.

One or more of each of the at least one longitudinal flange and each of the at least one transverse flange may comprise a groove for accommodating a gasket or a quantity of sealant.

The at least one longitudinal flange may comprise a first longitudinal flange comprising a protrusion and a second longitudinal flange comprising a groove sized to accommodate the protrusion of an adjacent corrugated metal plate, the first longitudinal flange and the second longitudinal flange each extending from a different respective longitudinal edge. The at least one transverse flange may comprise a first transverse flange comprising a protrusion and a second transverse flange comprising a groove sized to accommodate the protrusion of an adjacent corrugated metal plate, the first transverse flange and the second transverse flange each extending from a different respective transverse edge. The groove may be sized to accommodate a gasket or a quantity of sealant.

One or more of the at least one transverse flange and the at least one longitudinal flange may comprise one or more alignment features to engage an adjacent abutting plate. The alignment features may matingly engage alignment features of the adjacent abutting plate. Each of the at least one transverse flange may comprise a plurality of alignment features. Each of the at least one longitudinal flange may comprise a plurality of alignment features.

The corrugated metal plate may further comprise one or more stiffener flanges intermediate the transverse edges of the plate.

The plate may have a pitch between about 152.4 mm and about 500 mm, and a depth between about 50.8 mm and about 237 mm.

Each of the at least one longitudinal flange may be a single longitudinal flange extending generally the length of each longitudinal edge, and each of the at least one transverse flange may be a single transverse flange extending generally the length of each transverse edge.

In another aspect, there is provided an overhead structure comprising: a corrugated structure having corrugations extending transversely of the longitudinal length of the corrugated structure, the corrugated structure comprising a plurality of corrugated metal plates, each corrugated metal plate comprising a plate configured to define a series of crests and troughs, the plate having longitudinal edges extending parallel to longitudinal axes of the crests and the troughs and transverse edges extending orthogonally to the longitudinal axes of the crests and the troughs; and at least one of: at least one longitudinal flange extending from each longitudinal edge, and at least one transverse flange extending from each transverse edge, the flanges of adjacent corrugated metal plates abutting and being secured to each other.

The corrugated metal plates may be arranged in two layers so as to form a double layer of corrugated metal plates. The corrugated metal plates forming the double layer may define at least one interior cavity configured to be filled with concrete. The overhead structure may further comprise a plurality of shear studs attached to the corrugated metal plates within at least one of the cavities for providing a shear bond at the metal-concrete interface. The corrugated metal plates forming an inner layer may be separated from the corrugated metal plates forming an outer layer by spacer plates. The corrugated metal plates forming the double layer and the spacer plates may define at least one interior cavity configured to be filled with concrete. The overhead structure may further comprise a plurality of shear studs attached to one or more of the corrugated metal plates and the spacer plates within at least one of the cavities for providing a shear bond at the metal-concrete interface.

The overhead structure may further comprise at least one reinforcement member positioned between adjacent corrugated metal plates. The at least one reinforcement member may comprise one or more of a reinforcement rib, a reinforcement beam, a hollow structural section reinforcement rib, and a boxed reinforcement rib.

The overhead structure may further comprise sealant positioned between abutting longitudinal flanges of adjacent corrugated metal plates. The sealant may comprise one or more sealant strips.

One or more of the at least one transverse flange may comprise a first flange portion and a second flange portion. Each first flange portion may have an upturned orientation relative to the plate and each second flange portion may have a downturned orientation relative to the plate.

At least some of the longitudinal flanges may be generally centered on crests or troughs. The crests and troughs of at least some adjacent plates may be generally contiguous when the longitudinal flanges of the at least some adjacent plates abut.

For at least some of the corrugated metal plates, one or more of the at least one longitudinal flange and the at least one transverse flange may comprise a plurality of apertures for receiving fasteners.

At least some of the transverse flanges may extend non-orthogonally from the plates.

At least some of the corrugated metal plates may further comprise gussets adjoining each of the at least one transverse flanges to the plate.

For at least some of the corrugated metal plates, one or more of the at least one longitudinal flange and the at least one transverse flange may comprise a groove for accommodating a gasket or a quantity of sealant.

For at least some of the corrugated metal plates, each of the at least one longitudinal flange may comprise a first longitudinal flange having a protrusion and a second longitudinal flange having a groove sized to accommodate the protrusion of an adjacent corrugated metal plate, the first longitudinal flange and the second longitudinal flange each extending from a respective longitudinal edge of the plate. For at least some of the corrugated metal plates, each of the at least one transverse flange may comprise a first transverse flange comprising a protrusion and a second transverse flange comprising a groove sized to accommodate the protrusion of an adjacent corrugated metal plate, the first transverse flange and the second transverse flange each extending from a respective transverse edge of the plate. The groove may be sized to accommodate a gasket or a quantity of sealant.

For at least some of the corrugated metal plates, each of the at least one transverse flange may comprise one or more alignment features to engage an adjacent abutting plate. The alignment features may matingly engage alignment features of the abutting plate. Each of the at least one transverse flange may comprise a plurality of alignment features. For at least some of the corrugated metal plates, each of the at least one longitudinal flange may comprise one or more alignment features to engage an adjacent abutting plate. The alignment features may matingly engage alignment features of the abutting plate. Each of the at least one longitudinal flange may comprise a plurality of alignment features.

The corrugated metal plates may further comprise one or more stiffener flanges intermediate the transverse edges of the plates.

Each of the at least one longitudinal flange may comprise a single longitudinal flange extending generally the length of each longitudinal edge, and each of the at least one transverse flange may comprise a single transverse flange extending generally the length of each transverse edge.

At least some of the corrugated metal plates may be curved in one or more of a longitudinal direction and a transverse direction.

The corrugated structure may be curved, and the longitudinal flanges of adjacent plates may align to define circumferential flanges of the corrugated structure, and wherein the transverse flanges of adjacent plates may align to define longitudinal flanges of the corrugated structure.

The corrugated metal plates may have a pitch between about 152.4 mm and about 500 mm, and a depth between about 50.8 mm and about 237 mm.

In another aspect, there is provided a corrugated metal plate comprising a first flange extending along a first edge of the corrugated metal plate, the first flange having alignment features thereon to mate with complimentary alignment features of an adjacent plate.

The corrugated metal plate may further comprise a second flange extending along a second edge of the corrugated metal plate opposite the first edge and having alignment features thereon complimentary to the alignment features on the first flange. The corrugated metal may further comprise a third flange extending along a third edge of the corrugated metal plate, the third flange having alignment features thereon to mate with complimentary alignment features of an adjacent plate. The corrugated metal plate may further comprise a fourth flange extending along a fourth edge of the corrugated metal plate opposite the third edge and having alignment features thereon complimentary to the alignment features on the third flange.

The alignment features may comprise protrusions and notches. The first flange and the second flange may each comprise at least one protrusion or at least one notch, or both. The third flange and the fourth flange may each comprise at least one protrusion or at least one notch, or both.

In another aspect, there is provided a method of assembling a corrugated structure formed of corrugated metal plates, the corrugated structure having corrugations extending transversely of the longitudinal length of the corrugated structure, at least some of the corrugated metal plates comprising a longitudinal flange extending from each longitudinal edge and a transverse flange extending from each transverse edge, at least some of the flanges comprising alignment features, the method comprising: bringing adjacent plates into abutting relationship such that alignment features on adjacent plates matingly engage; installing fasteners through aligned holes to secure abutting plates; and repeating the bringing and the installing as necessary until the corrugated structure is assembled.

The flanges may be on the exterior of the corrugated structure, and wherein the installing is performed outside the corrugated structure. The flanges may be on the interior of the corrugated structure, and wherein the installing is performed inside the corrugated structure.

Each of the transverse flanges may comprise a first flange portion and a second flange portion. Each first flange portion may have an upturned orientation relative to the plate and each second flange portion may have a downturned orientation relative to the plate.

The method may further comprise adding sealant between abutting flanges. The sealant may comprise one or more sealant strips.

At least some of the corrugated metal plates may be curved in one or more of a longitudinal direction and a transverse direction.

The corrugated structure may be curved, and wherein the longitudinal flanges of adjacent plates align to define circumferential flanges of the corrugated structure, and wherein the transverse flanges of adjacent plates align to define longitudinal flanges of the corrugated structure.

The alignment features may comprise protrusions and notches. Each of the at least some longitudinal flanges may comprise at least one protrusion or at least one notch, or both. Each of the at least some transverse flanges may comprise at least one protrusion or at least one notch, or both.

The method may further comprise positioning an intermediate plate between adjacent plates having different corrugation profile.

The method may further comprise positioning at least one reinforcement member between adjacent corrugated metal plates. The at least one reinforcement member may comprise one or more of a reinforcement rib, a reinforcement beam, a hollow structural section reinforcement rib, and a boxed reinforcement rib.

At least one of the corrugated metal plates may comprise transverse flanges that extend non-orthogonally from the plate. The method may further comprise installing the at least one corrugated metal plate having the transverse flanges that extend non-orthogonally from the plate as a keystone plate of the corrugated structure.

The corrugated metal plates may have a pitch between about 152.4 mm and about 500 mm, and a depth between about 50.8 mm and about 237 mm.

BRIEF DESCRIPTION OF THE DRAWINGS

Embodiments will now be described with reference to the accompanying drawings in which.

DETAILED DESCRIPTION OF THE EMBODIMENTS

Figure 1:
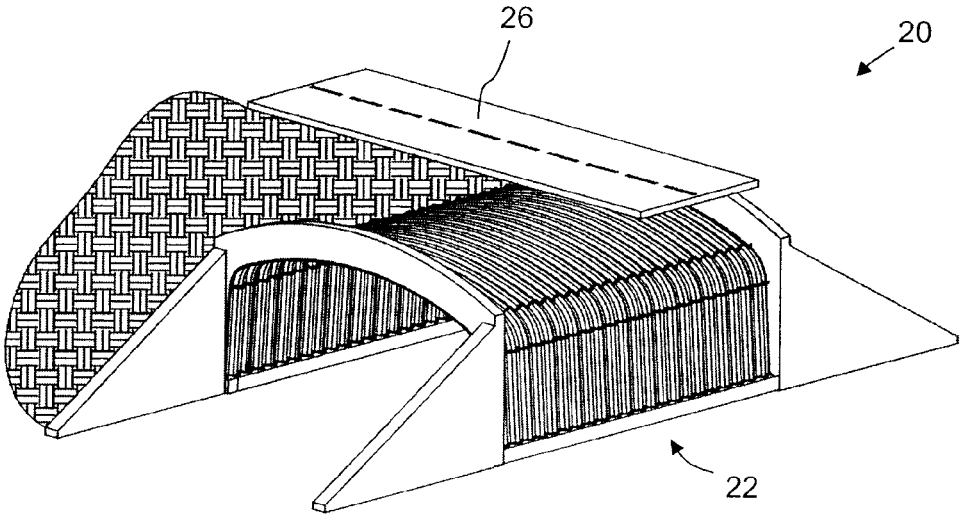
FIG. 1 is a perspective view of an underpass system comprising an overhead structure.
Figure 2:
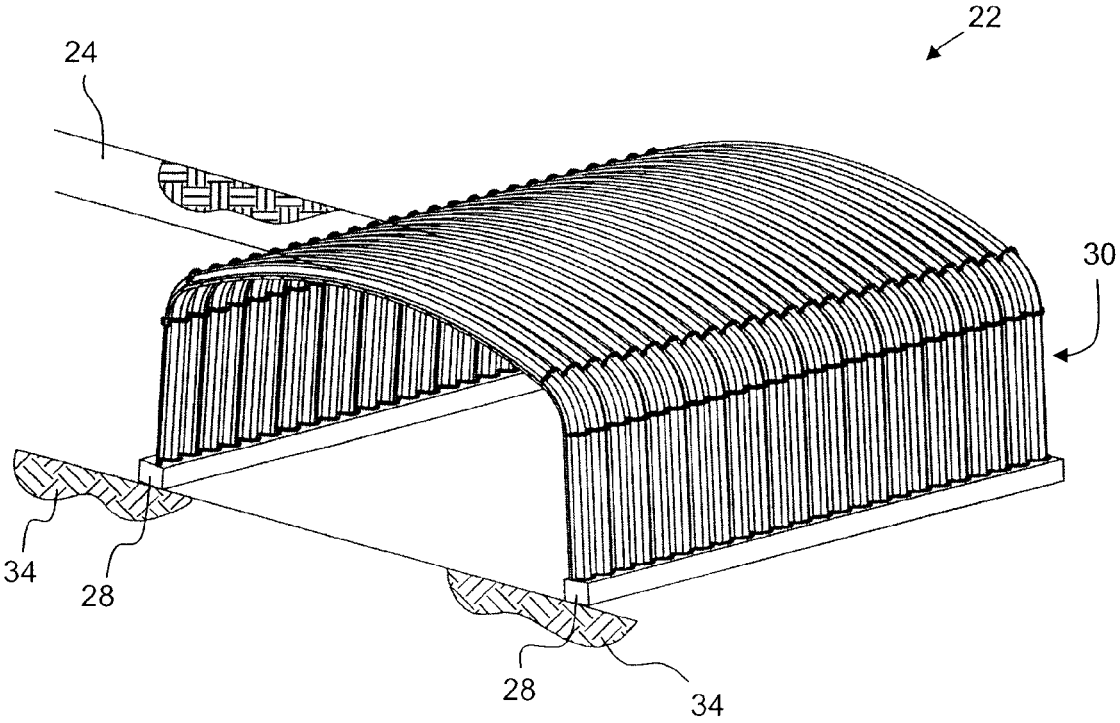
FIG. 2 is a perspective view of a metal archway and footings forming part of the overhead structure of FIG. 1.

Turning now to FIGS. 1 and 2, a representative underpass system or similar thoroughfare infrastructure is shown and is generally identified by reference numeral 20. As can be seen, the underpass system comprises an overhead structure 22 constructed of interconnected corrugated metal plates or sheets, and in the embodiment shown, overhead structure 22 is a box-type structure. Above the overhead structure 22 is a prescribed depth of overburden 24, on top of which is a roadway 26 constructed in the usual manner. In the embodiment shown, the overhead structure 22 comprises a pair of footings 28 and a metal archway 30 supported by the footings 28. The metal archway 30 is constructed from a plurality of interconnected structural corrugated metal plates defining alternating crests and troughs. The crests and troughs extend transversely of the longitudinal length of the metal archway 30. The corrugated metal plates are secured together by fasteners so as to achieve the desired erected structure, as will be described below. The footings 28 are placed on compacted fill, above which is a layer of compacted granular material 34. A roadway (not shown) formed of a layer of reinforced concrete and/or compacted asphalt is provided on the compacted granular material 34 and extends through the metal archway 30.

Figure 3:
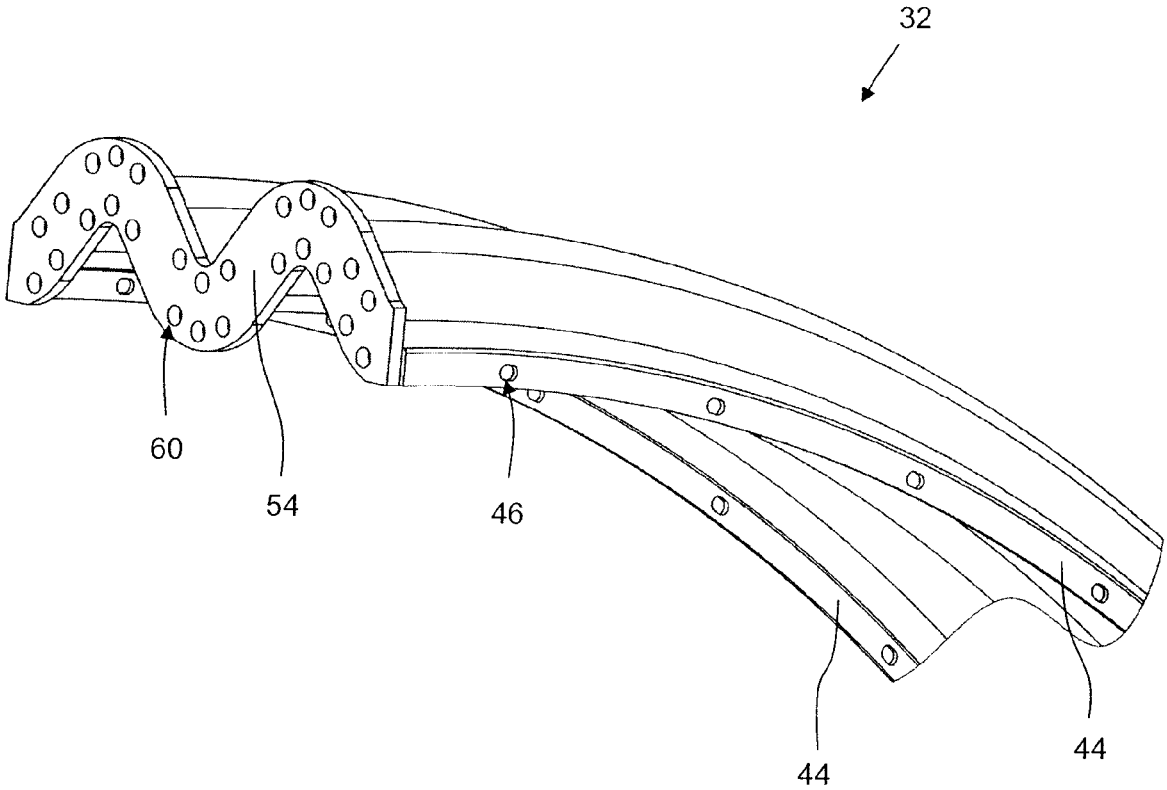
FIG. 3 is a perspective view of a portion of a corrugated metal plate forming part of the metal archway of FIG. 2.
Figure 4:
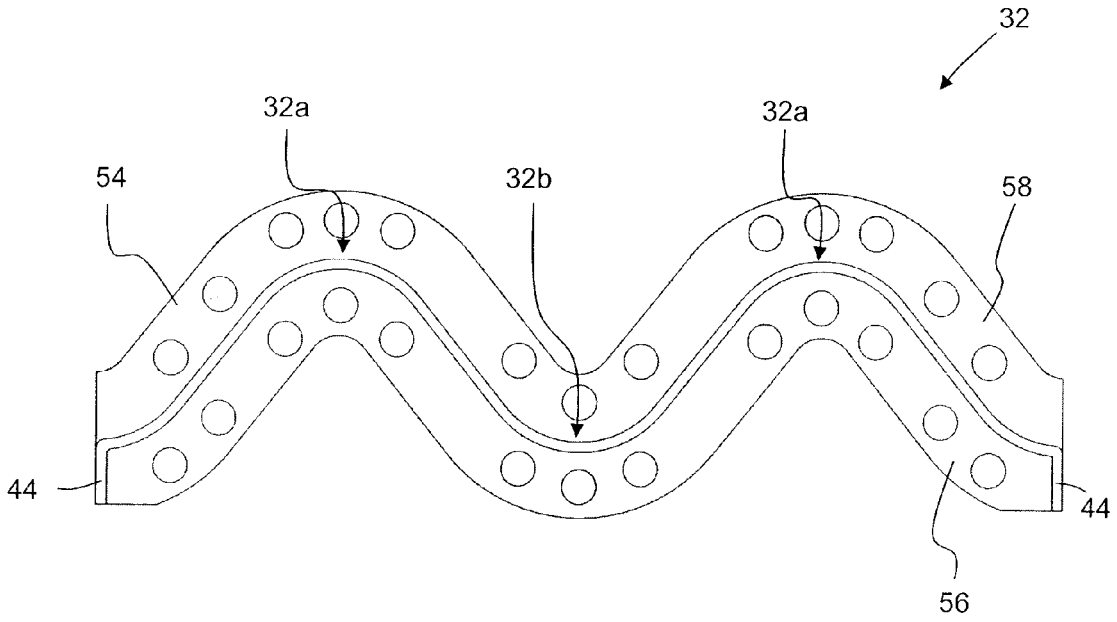
FIG. 4 is a sectional view of the corrugated metal plate of FIG. 3.

Turning now to FIGS. 3 and 4, one of the corrugated metal plates forming part of the metal archway 30 is shown, and is generally indicated by reference numeral 32. Corrugated metal plate 32 is formed so as to define alternating crests 32*a* and troughs 32*b* extending the length of the corrugated metal plate 32, and in this embodiment, corrugated metal plate 32 is a steel plate. The corrugated metal plate 32 is circumferentially curved, whereby the crests and troughs are curved along their lengths and thereby define a circumferential radius of curvature of the plate 32. As will be appreciated, such circumferential curvature allows the plate 32 to be well-suited for use in the curved metal archway 30.

Plate 32 has longitudinal circumferential edges or opposite sides that are generally parallel to the lengths of the crests 32*a* and the troughs 32*b*. Extending generally the length of each longitudinal circumferential edge is a longitudinal circumferential flange 44 for providing a surface against which any of, for example, a longitudinal circumferential flange 44 of an adjacent plate 32, a reinforcement member, or any suitable support surface, can abut. In this embodiment, the longitudinal circumferential flanges 44 are formed by bending the plate 32 along the longitudinal circumferential edges and, as shown, the longitudinal circumferential flanges 44 are downturned relative to the plate 32. Each longitudinal circumferential flange 44 has a plurality of spaced apertures 46 formed therein, with each aperture 46 being configured to receive a respective fastener. In this embodiment, the fasteners are bolts 48, although it will be appreciated that other suitable fasteners (welds, rivets, etc.) can be used.

In the embodiment shown, the alternating crests 32*a* and troughs 32*b* define a periodic pattern, and the longitudinal circumferential flanges 44 are positioned so as to be generally centered on the troughs 32*b* of the plate 32. In this manner, when flanges 44 of adjacent plates 32 abut, the periodic pattern of crests 32*a* and troughs 32*b* is maintained across abutting plates 32. In this embodiment, the plate 32 has a pitch, and namely a spacing between adjacent crests 32*a*, of about 381 mm, and a depth, and namely the distance from the bottom of a trough 32*b* to the top of a crest 32*a*, of about 140 mm.

Each plate 32 is terminated by transverse edges or opposite ends that are generally orthogonal to the lengths of the crests 32*a* and the troughs 32*b*. Extending generally the length of each transverse edge, and following the contour of the crests 32*a* and troughs 32*b*, is a transverse flange 54. In this embodiment, each transverse flange 54 is joined to the plate 32 by welding, and is sized and positioned so as to provide a first flange portion 56 having a downturned orientation relative to the plate 32 and a second flange portion 58 having an upturned orientation relative to the plate 32. The transverse flange 54 is configured to provide a surface against which any of, for example, a transverse flange 54 of an adjacent plate 32, a footing 28, a reinforcement member, or other suitable support surface, can abut. Each transverse flange 54 has a plurality of apertures 60 formed therein, with each aperture 60 being configured to receive a respective fastener. In this embodiment, the fasteners are bolts 48, although it will be appreciated that other suitable fasteners (welds, rivets, etc.) can be used.

The longitudinal circumferential flanges 44 and transverse flanges 54 advantageously allow butt joints to be formed between adjacent plates 32. As will be understood, such butt joints inherently provide an axial strength that is largely a function of the axial strength of the plate material, and which is higher than the axial strength of lap joints formed by overlapping conventional corrugated metal plates. In the latter case, the axial strength of the lap joint is largely a function of the shear strength of fasteners passing through the overlapping plate portions.

Additionally, the butt joints formed between adjacent plates 32 advantageously enable the overhead structure 22 to be assembled from a single side of the overhead structure, such as either above or below the overhead structure, as compared to an overhead structure formed by overlapping conventional plates, for which two or more individuals are typically required to affix each bolt to the structure. Those of skill in the art will appreciate that this feature enables assembly of overhead structures using robotic or automated assembly equipment, as will be further described below.

Figure 5:
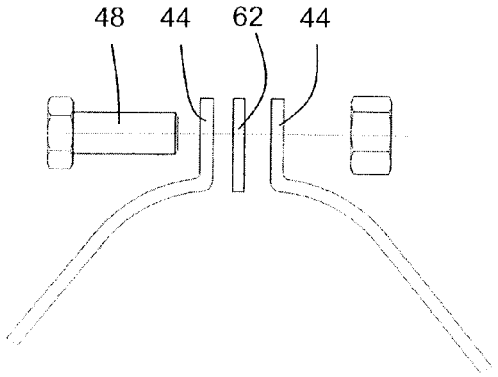
FIG. 5 is an exploded partial view of a sealant strip positioned between two corrugated metal plates of FIG. 3.

In this embodiment, the metal archway 30 further comprises sealant strips 62 positioned between abutting longitudinal circumferential flanges 44 of adjacent plates 32, as shown in FIG. 5, and between abutting transverse flanges 54 of adjacent plates 32. Each sealant strip 62 has a plurality of apertures (not shown) therein, which are sized and positioned so as to align with the apertures 46 and 60 of the flanges 44 and 54, respectively, with each aperture enabling a respective fastener 48 to pass therethrough. As will be understood, the sealant strip 62 provides a seal against the flow of fluid, such as rain water or groundwater, through joints formed between the adjacent plates 32, and thereby advantageously provides general water-tightness to the assembled metal archway 30 and also advantageously enables the assembled metal archway 30 to maintain fluid pressure. In this embodiment, sealant strip 62 is a strip of resilient polymeric material, however those of skill in the art will understand that sealant strip 62 may alternatively be a quantity of a suitable sealing material, such as for example caulking, or a rubber gasket, and the like.

As will be appreciated, the sealant strip 62 may be used in conjunction with, or substituted with, a squeeze block (not shown) positioned between abutting longitudinal circumferential flanges 44 of adjacent plates 32, and/or between abutting transverse flanges 54 of adjacent plates 32. The squeeze block is a slab of resilient material that generally absorbs loads exerted on the metal archway 30. As will be understood, the use of plates 32 having longitudinal circumferential flanges 44 and transverse flanges 54 allows squeeze blocks to advantageously be incorporated at multiple locations within the metal archway 30, and not only between the plates and footings as in prior art metal archways formed of conventional corrugated metal plates as described in, for example, U.S. Pat. No. 4,010,617 to Armco Steel Corporation. Such incorporation of squeeze blocks at multiple locations within the metal archway 30 enables the metal archway 30 to have increased resistance to loads imposed thereon, as compared to prior art metal archways.

As will be understood, when the overhead structure 22 is assembled, the corrugated metal plates 32 are connected end to end and side by side with the transverse flanges 54 and the longitudinal flanges 44 of adjacent corrugated metal plates 32 being in abutment.

When the overhead structure 22 is assembled, the transverse flanges align to define longitudinal flanges that extend parallel to the longitudinal length of the metal archway 30, and the longitudinal circumferential flanges align to define circumferential flanges that extend in a circumferential direction of the metal archway 30. Accordingly, for ease of description of some embodiments described below, the transverse flanges of the corrugated metal plates are referred to as longitudinal flanges, and the longitudinal circumferential flanges of the corrugated metal plates are referred to as circumferential flanges.

Figure 6A:
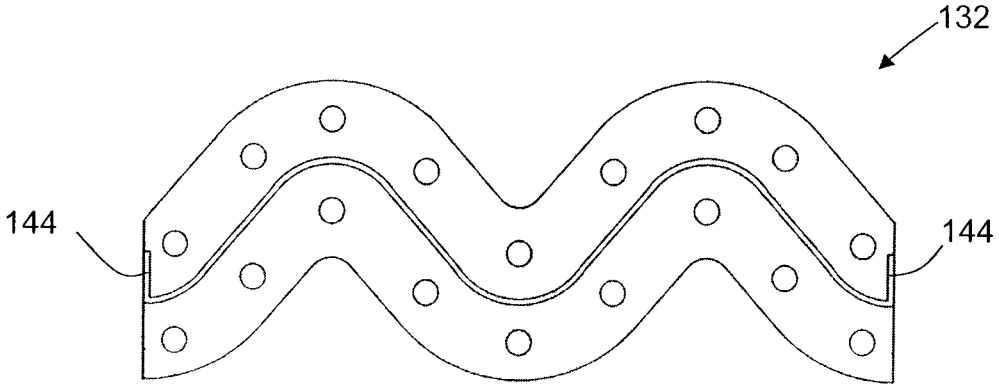
FIGS. 6*a* to 6*f* are sectional views of alternative embodiments of corrugated metal plates for use in the metal archway of FIG. 2.

The flange configuration of the corrugated metal plate is not limited to that of the embodiment described above and in other embodiments, the corrugated metal plate may have other flange configurations. For example, FIG. 6*a* shows another embodiment of a corrugated metal plate for use in the metal archway 30, and which is generally indicated by reference numeral 132. Plate 132 is generally similar to plate 32 described above and with reference to FIGS. 3 to 5, but comprises an upturned circumferential flange 144 extending the length of each circumferential edge.

Figure 6B:
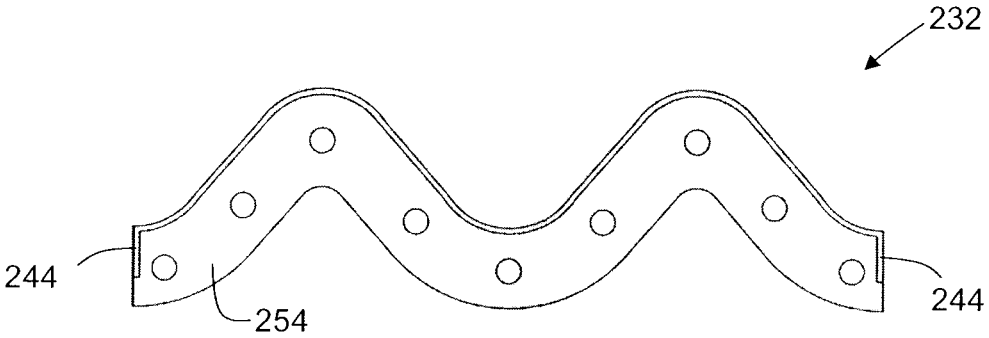

Still other configurations are possible. FIG. 6*b* shows another embodiment of a corrugated metal plate for use in the metal archway 30, and which is generally indicated by reference numeral 232. Plate 232 is generally similar to plate 32 described above and with reference to FIGS. 3 to 5, but comprises a longitudinal flange 254 extending the length of each longitudinal edge, and following the contour of the crests and troughs. Each longitudinal flange 254 is sized and positioned so as to have a downturned orientation relative to the plate 232. Plate 232 also comprises a downturned circumferential flange 244 extending the length of each circumferential edge. As will be appreciated, fasteners may be more easily inserted through apertures (not shown) of the downturned circumferential flanges 244 of plate 232 as compared to, for example, through apertures (not shown) of the upturned circumferential flanges 144 of plate 132 described above and with reference to FIG. 6*a*.

Figure 6C:
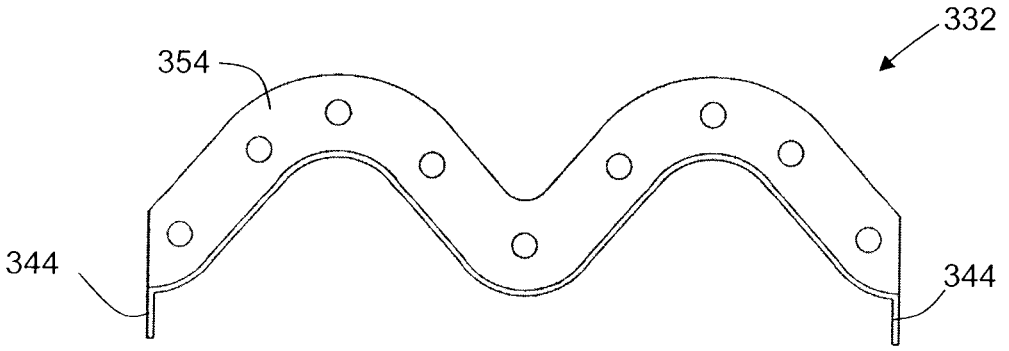

FIG. 6*c* shows still another embodiment of a corrugated metal plate for use in the metal archway 30, and which is generally indicated by reference numeral 332. Plate 332 is generally similar to plate 32 described above and with reference to FIGS. 3 to 5, but comprises a longitudinal flange 354 extending the length of each longitudinal edge, and following the contour of the crests and troughs. Each longitudinal flange 354 is sized and positioned so as to have an upturned orientation relative to the plate 332. Plate 332 also comprises a downturned circumferential flange 344 extending the length of each circumferential edge.

Figure 6D:
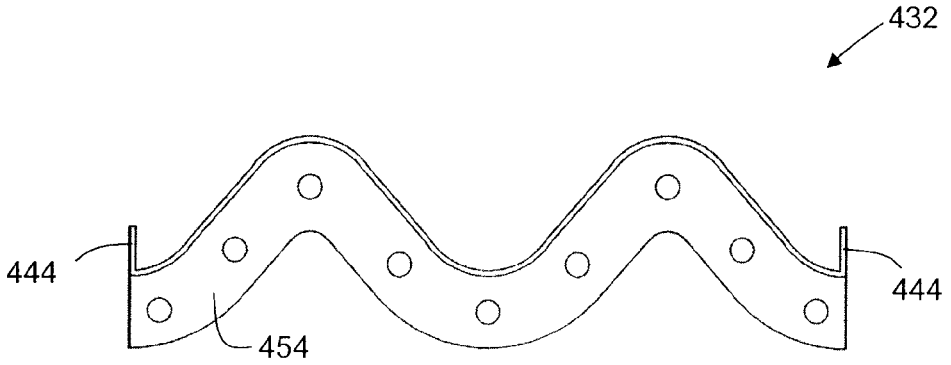

FIG. 6*d* shows still another embodiment of a corrugated metal plate for use in the metal archway 30, and which is generally indicated by reference numeral 432. Plate 432 is generally similar to plate 132 described above and with reference to FIG. 6*a*, but comprises a longitudinal flange 454 extending the length of each longitudinal edge, and following the contour of the crests and troughs. Each longitudinal flange 454 is sized and positioned so as to have a downturned orientation relative to the plate 432. Plate 432 also comprises an upturned circumferential flange 444 extending the length of each circumferential edge.

Figure 6E:
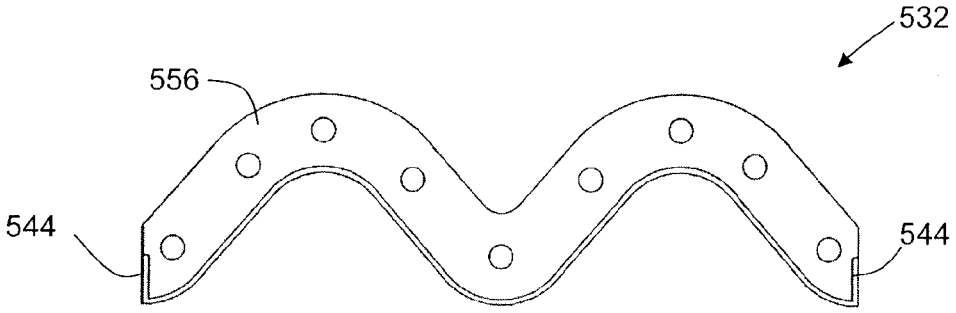

FIG. 6*e* shows still another embodiment of a corrugated metal plate for use in the metal archway 30, and which is generally indicated by reference numeral 532. Plate 532 is generally similar to plate 132 described above and with reference to FIG. 6*a*, but comprises a longitudinal flange 556 extending the length of each longitudinal edge, and following the contour of the crests and troughs. Each longitudinal flange 556 is sized and positioned so as to have an upturned orientation relative to the plate 532. Plate 532 also comprises an upturned circumferential flange 544 extending the length of each circumferential edge.

Figure 6F:
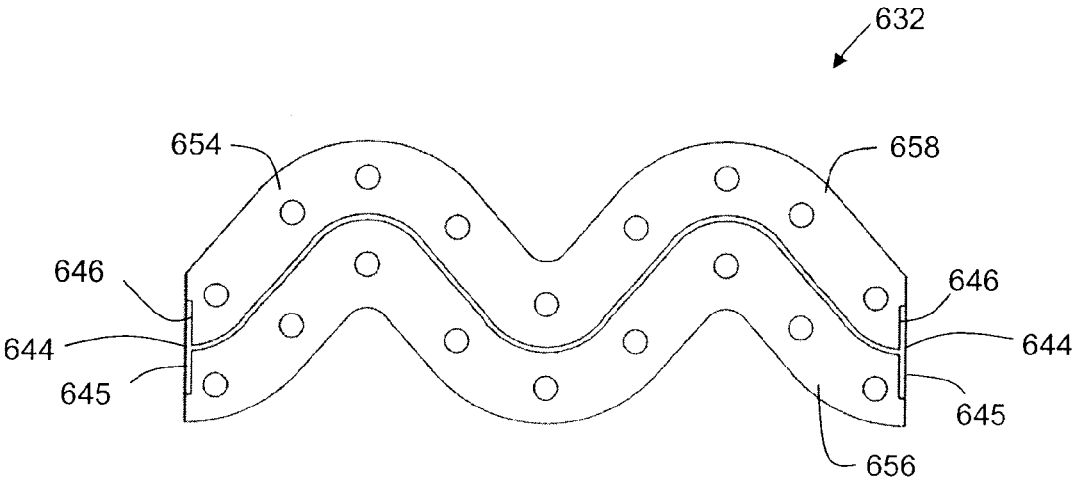

The corrugated metal plates may alternatively comprise both upturned and downturned circumferential flanges. For example, FIG. 6*f* shows still another embodiment of a corrugated metal plate for use in the metal archway 30, and which is generally indicated by reference numeral 632. Plate 632 is generally similar to plate 32 described above and with reference to FIGS. 3 to 5, but comprises a circumferential flange 644 extending the length of each circumferential edge and that is joined to the plate 632 by welding. Each circumferential flange 644 is sized and positioned so as to provide a first circumferential flange portion 645 having a downturned orientation relative to the plate 632 and a second circumferential flange portion 646 having an upturned orientation relative to the plate 632. Plate 632 also comprises a longitudinal flange 654 extending the length of each longitudinal edge, and following the contour of the crests and troughs. Each longitudinal flange 654 is sized and positioned so as to provide a first flange portion 656 having a downturned orientation relative to the plate 632 and a second flange portion 658 having an upturned orientation relative to the plate 632.

It will be appreciated that the corrugated metal plates described above and with reference to FIGS. 3 to 6*f* are well suited for use in curved structures, such as for example tunnel linings. In tunnel linings, for example, curved corrugated metal plates having circumferential flanges and longitudinal flanges facing the interior of the structure may be required, so as to enable assembly of the structure from within its interior.

The corrugated metal plates shown in FIGS. 3 to 6*f*, and in other embodiments below, are circumferentially curved, whereby the crests and troughs are curved along their lengths and thereby define a circumferential radius of curvature of the plate. However, those skilled in the art will understand that the corrugated metal plate may alternatively be generally flat, whereby the lengths of the crests and troughs define generally parallel planes that extend the length of the plate. Those skilled in the art will also understand that the corrugated metal plate may, or alternatively, be longitudinally curved, whereby the longitudinal edges are curved and thereby define a longitudinal radius of curvature of the plate. Those skilled in the art will also understand that the radius or radii of curvature may not be constant, and may vary along one or more of the circumferential and longitudinal edges of the plate.

Figure 7A:
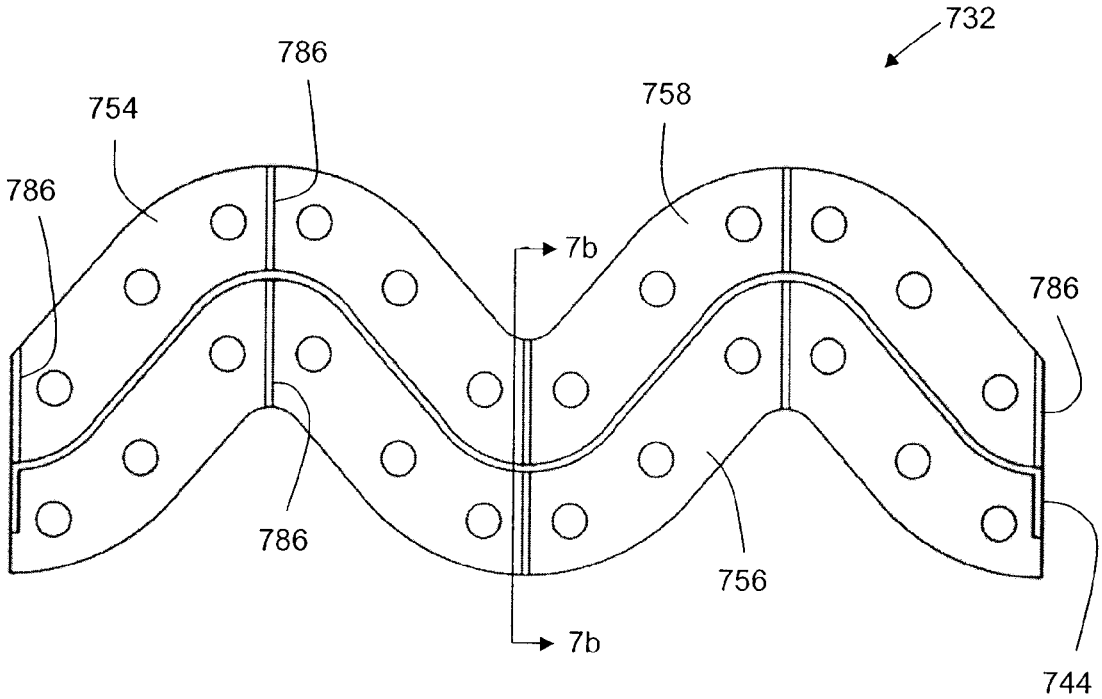
FIG. 7*a* is a sectional view of another embodiment of a corrugated metal plate for use in the metal archway of FIG. 2.
Figure 7B:
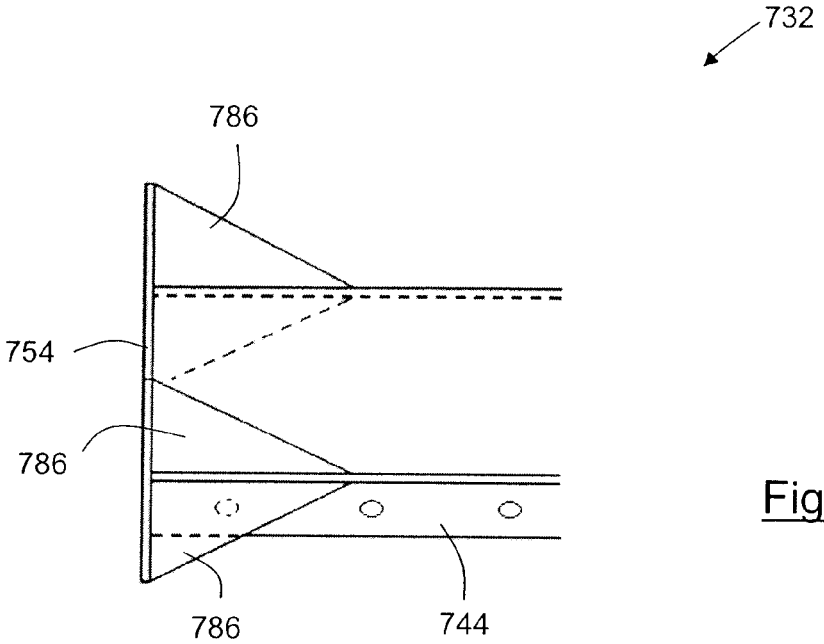
FIG. 7*b* is a sectional view of the corrugated metal plate of FIG. 7*a* taken along the section line 7*b*-7*b;*

FIGS. 7*a* and 7*b* show another embodiment of a corrugated metal plate for use in the metal archway 30, and which is generally indicated by reference numeral 732. Plate 732 is generally similar to plate 32 described above and with reference to FIGS. 3 to 5, and comprises a downturned circumferential flange 744 extending the length of each circumferential edge, and a longitudinal flange 754 that extends the length of each longitudinal edge. Each longitudinal flange 754 is sized and positioned so as to provide a first flange portion 756 having a downturned orientation relative to the plate 732 and a second flange portion 758 having an upturned orientation relative to the plate 732. Plate 732 further comprises gussets 786 adjoining the first and second flange portions 756 and 758 to the plate 732. In the embodiment shown, gussets 786 are positioned on the crests and troughs of the plate 732, however those of skill in the art will understand that gussets 786 may be positioned on other locations of the plate 732, such as only on the crests, only on the troughs, at positions intermediate crests and troughs, and the like. As will be understood, the gussets 786 provide support for the longitudinal flanges 754, and thereby strengthen the plate 732.

Figure 8A:
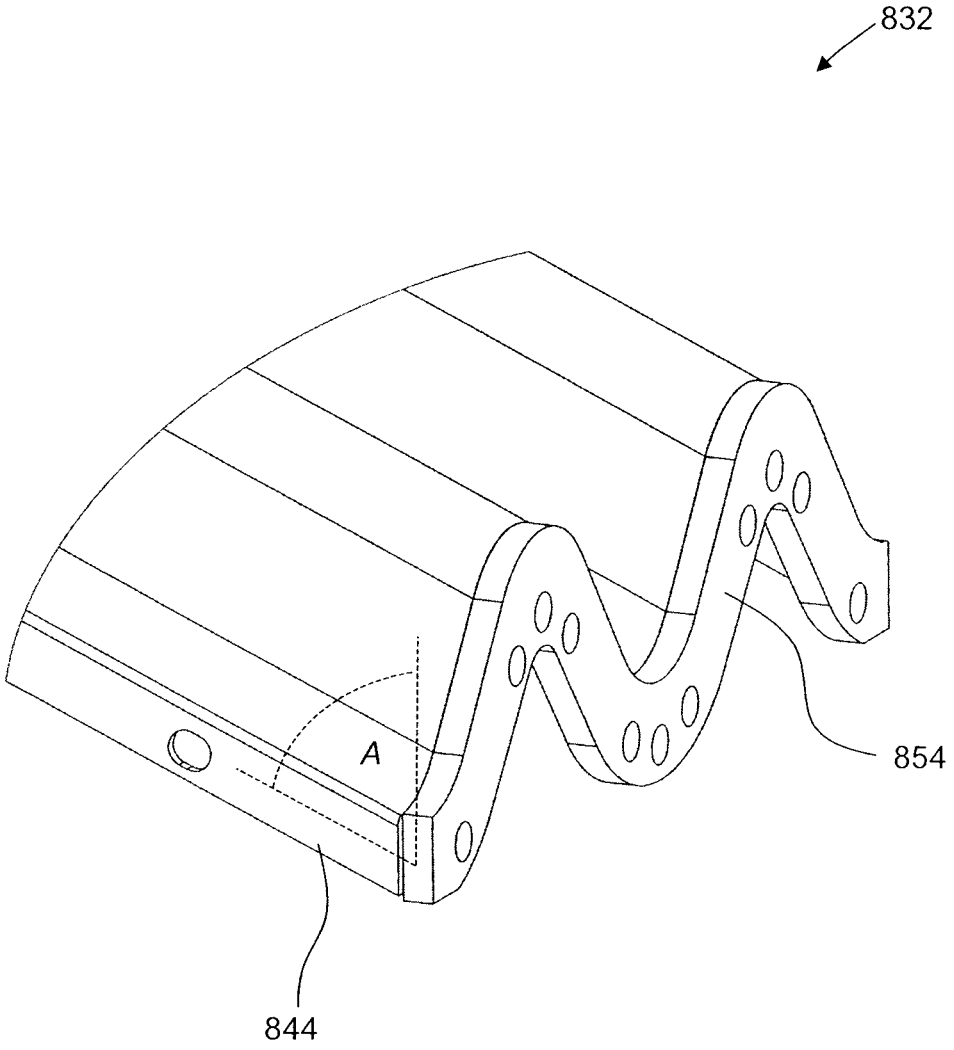
FIG. 8*a* is a perspective view of a portion of another embodiment of a corrugated metal plate for use in the metal archway of FIG. 2.

In other embodiments, the flanges may alternatively extend from the plate non-orthogonally. For example, FIG. 8*a* shows a portion of another embodiment of a corrugated metal plate for use in the metal archway 30, and which is generally indicated by reference numeral 832. Plate 832 is generally similar to plate 232 described above and with reference to FIG. 6*b*, and comprises a longitudinal flange 854 that extends the length of each longitudinal edge and following the contour of the crests and troughs. Each longitudinal flange 854 has a generally downturned orientation relative to the plate 832, and extends from the plate 832 non-orthogonally so as to form an inclination angle A with the plate 832, and where angle A does not equal 90 degrees, as shown by the dotted lines. Similar to plate 232, plate 832 also comprises a downturned circumferential flange 844 extending the length of each circumferential edge.

Figure 8B:
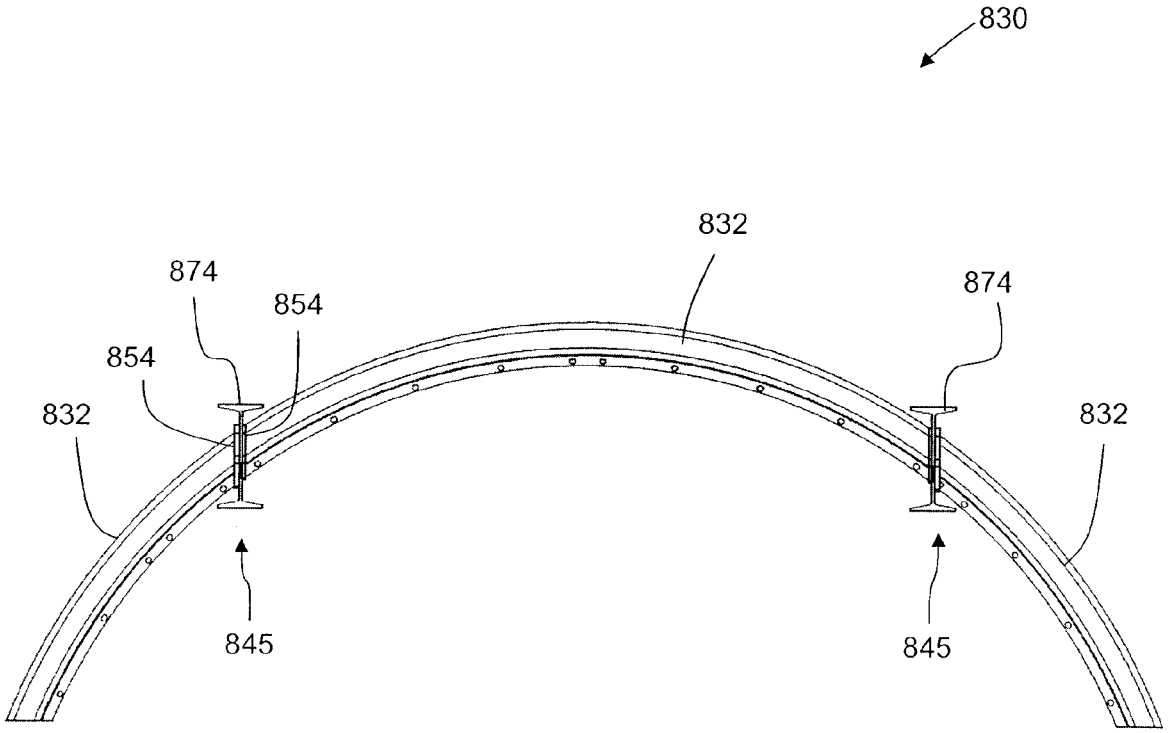
FIG. 8*b* is a front view of a portion of another embodiment of a metal archway.

It will be understood that that two (2) adjacent and abutting plates 832 may be oriented non-horizontally so as to advantageously define a generally vertical butt joint. Plate 832 is therefore well-suited for use in curved structures, such as for example a metal archway or a tunnel lining, where vertical butt joints may be desired for providing support points for suspending an apparatus within the interior of the curved structure. For example, FIG. 8*b* shows a portion of another embodiment of a metal archway 830 constructed from plates 832. As may be seen, longitudinally extending I-beams 874 that extend a portion of the length of the metal archway 830 are positioned between circumferentially adjacent plates 832. The longitudinal flanges 854 of two (2) adjacent plates 832, and the I-beams 874, define generally vertical butt joints 845. The butt joints 845 may provide support points for suspending an apparatus (not shown) within the interior of the metal archway 830.

Figure 8C:
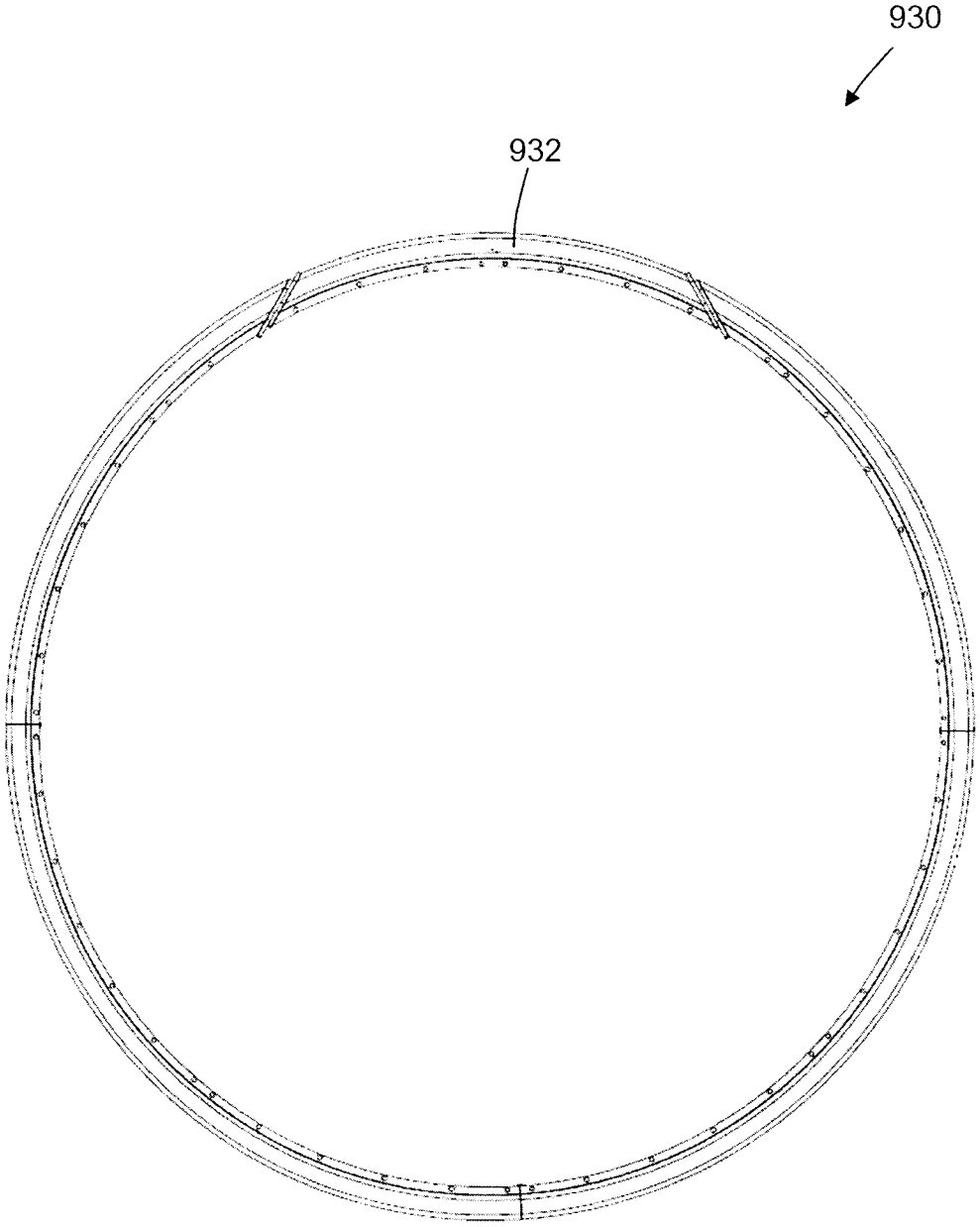
FIG. 8*c* is a front view of a tunnel lining.
Figure 8D:
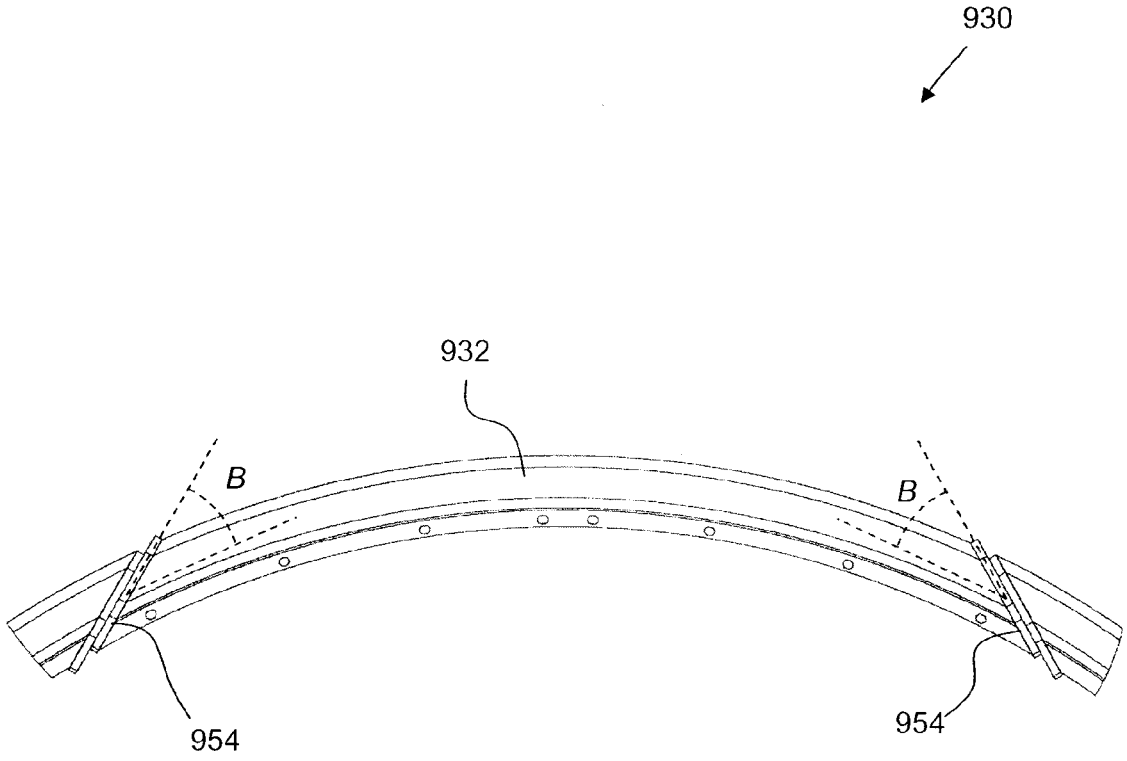
FIG. 8*d* is a side view of another embodiment of a corrugated metal plate forming part of the tunnel lining of FIG. 8*c;*

It will be appreciated that a corrugated metal plate having non-orthogonal longitudinal flanges is well-suited for use in curved structures, such as for example in a metal archway or a tunnel lining, and where the non-orthogonal longitudinal flanges allow the plate to be easily inserted as the final or "keystone" piece of the curved structure during assembly. For example, FIGS. 8*c* and 8*d* show a plate 932 having two longitudinal flanges 954 that extend from the plate 932 non-orthogonally, and each of which forms an inclination angle B with the plate 932, with angle B being less than 90 degrees. As will be understood, the configuration of the two non-orthogonal longitudinal flanges 954 allows the plate 932 to be inserted as the final piece of a tunnel lining 930 during assembly.

Figure 8E:
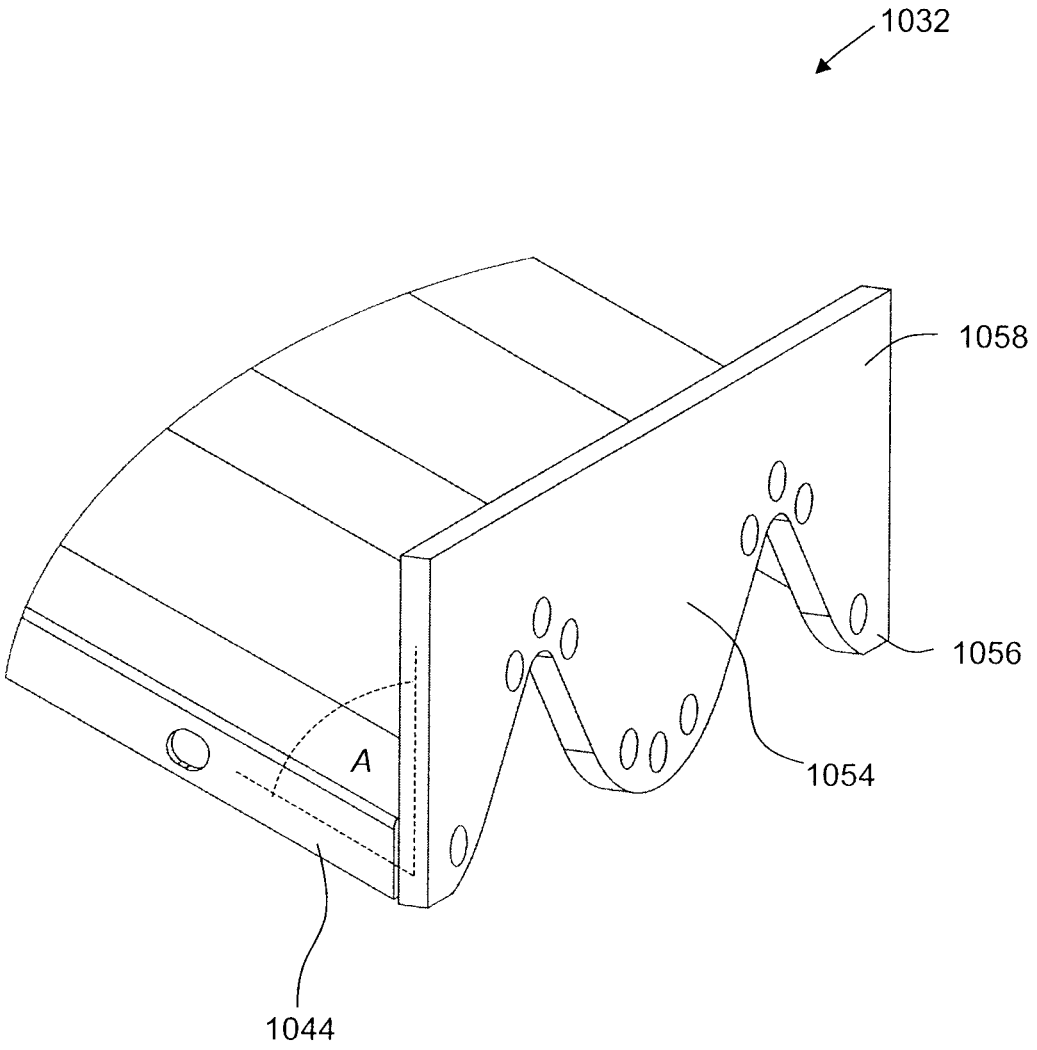
FIG. 8*e* is a perspective view of a portion of another embodiment of a corrugated metal plate for use in the metal archway of FIG. 2.

FIG. 8*e* shows a portion of another embodiment of a corrugated metal plate for use in the metal archway 30, and which is generally indicated by reference numeral 1032. Plate 1032 is generally similar to plate 832 described above and with reference to FIG. 8*a*, but comprises a longitudinal flange 1054 that extends the length of each longitudinal edge. Each longitudinal flange 1054 is sized, shaped and positioned so as to provide a first flange portion 1056 and having a generally downturned orientation relative to the plate 32 and following the contour of the crests and troughs, and a second flange portion 1058 having a generally upturned orientation relative to the plate 32 and having a rectangular profile. The longitudinal flange 1054 extends from the plate 1032 non-orthogonally so as to form an inclination angle A with the plate 1032, and where angle A does not equal 90 degrees, as shown in FIG. 8*e*. Plate 1032 also comprises a downturned circumferential flange 1044 extending the length of each circumferential edge.

Figure 9A:
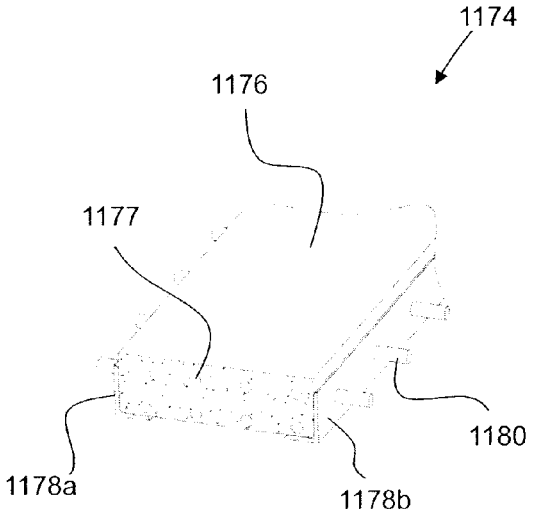
FIGS. 9*a*, 9*b* and 9*c* are perspective views of portions of a reinforcement rib, a reinforcement beam and a concrete-filled hollow structural section reinforcement rib, respectively, for use in the metal archway of FIG. 2.

To provide additional support and to increase the load carrying capabilities of the overhead structure 22, one or more reinforcement members can be secured to the overhead structure 22. For example, an embodiment of a reinforcement member in the form of a reinforcement rib for use in the metal archway 30, and which is generally indicated by reference numeral 1174 is shown in FIG. 9*a*. Reinforcement rib 1174 comprises a central core 1176 having a longitudinal shape. In this embodiment, the central core 1176 is cast concrete, and comprises an arrangement of reinforcement rods 1177 extending lengthwise within the central core 1176. Reinforcement rib 1174 further comprises mounting plates 1178*a* and 1178*b* affixed to the core 1176. Each mounting plate 1178*a* and 1178*b* comprises a plurality of threaded studs 1180 extending outwardly therefrom. Threaded studs 1180 are sized and positioned to be received in apertures formed in the circumferential flanges of corrugated metal plates, enabling the reinforcement rib 1174 to be secured to one or more corrugated metal plates.

Figure 9B:
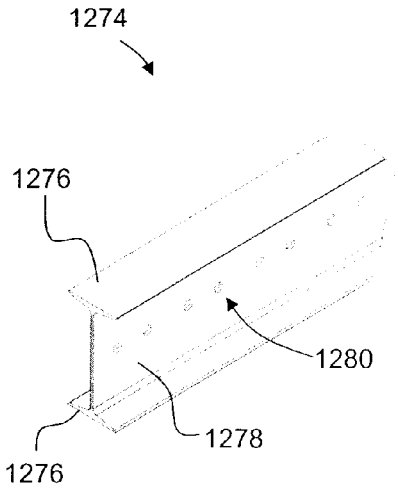

Other forms of reinforcement members may be used. For example, FIG. 9*b* shows another embodiment of a reinforcement member in the form of a reinforcement beam, and which is generally indicated using reference numeral 1274. In the embodiment shown, reinforcement beam 1274 is in the form of a steel I-beam, and comprises a pair of flanges 1276 joined by a central web 1278 extending the length of flanges 1276. The web 1278 comprises a plurality of apertures 1280 therethrough that are positioned so as to align with apertures formed in circumferential flanges of corrugated metal plates, enabling the reinforcement beam 1274 to be secured to one or more corrugated metal plates.

It will be understood that the reinforcement beam is not limited to an I-beam configuration, and may be in the form of a beam of different cross-sectional shape, such as for example a C-beam, a T-beam, a box beam, a hollow structural section (HSS), or a beam of other suitable cross-sectional shape.

Figure 9C:
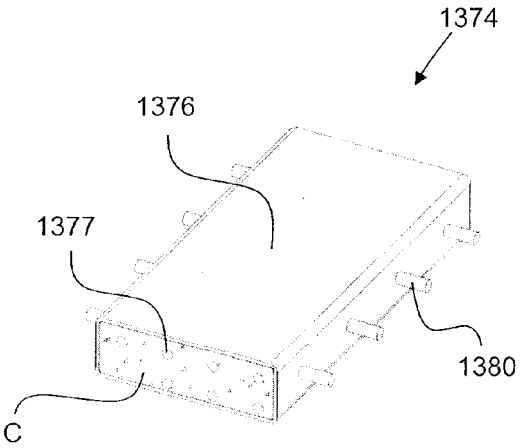

Still other forms of reinforcement members may be used. For example, FIG. 9*c* shows a concrete-filled HSS reinforcement rib for use with the corrugated metal plate 32, and which is generally indicated using reference numeral 1374. HSS reinforcement rib 1374 comprises a hollow structural section 1376 having an interior cavity C. In this embodiment, the interior cavity C is filled with concrete and comprises an arrangement of reinforcement rods 1377 extending lengthwise within the cavity C. HSS reinforcement rib 1374 further comprises a plurality of threaded studs 1380 extending outwardly from the hollow structural section 1376. Threaded studs 1380 are sized and positioned to be received in apertures formed in the circumferential flanges of corrugated metal plates, enabling the HSS reinforcement rib 1374 to be secured to one or more corrugated metal plates.

Although the portions of the reinforcement rib 1174, the reinforcement beam 1274 and the HSS reinforcement rib 1374 are shown in FIGS. 9*a* to 9*c* as being generally flat, it will be understood that these reinforcement members may be circumferentially curved over their lengths, as needed, for allowing the reinforcement members to be used in the metal archway 30.

Figure 9D:
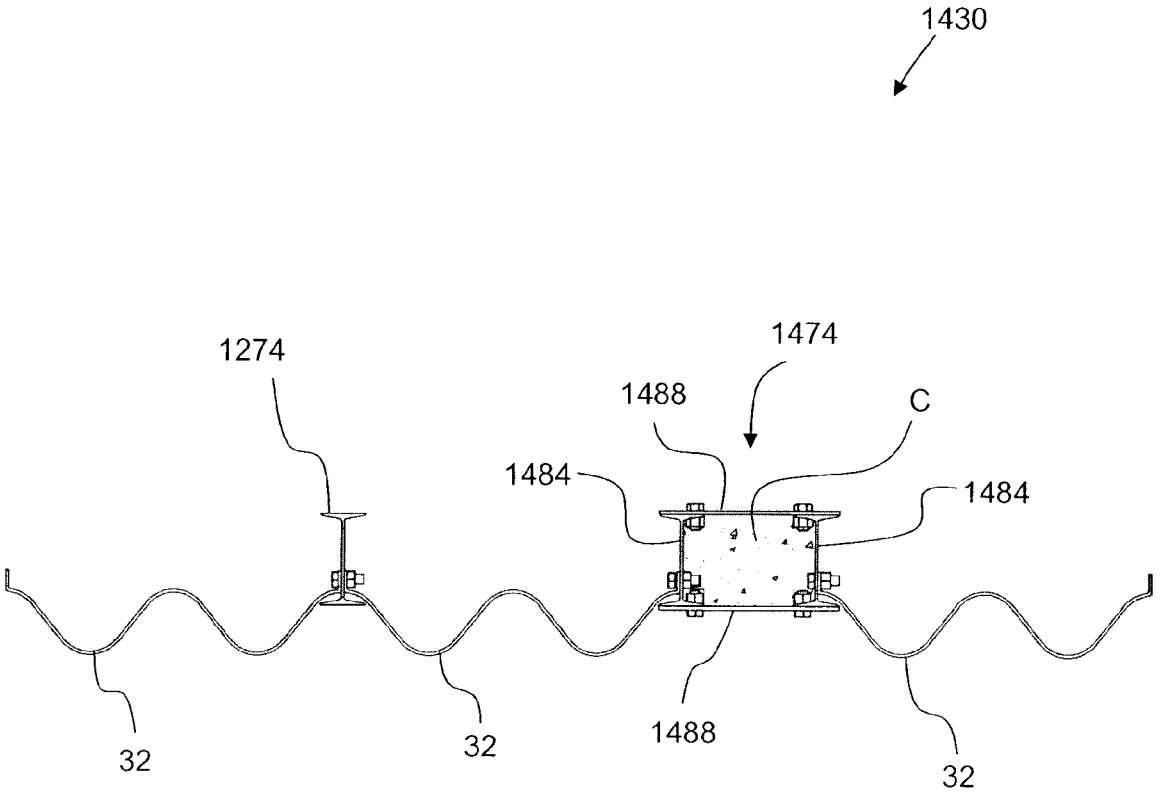
FIG. 9*d* is a sectional view of a portion of another embodiment of a metal archway, constructed from the reinforcement beam of FIG. 9*b* and a boxed reinforcement rib for use in the metal archway of FIG. 2.

Still other forms of reinforcement members may be used. For example FIG. 9*d* shows a portion of another embodiment of a metal archway, which is generally referred to using reference numeral 1430 and which is constructed from corrugated metal plates 32. Metal archway 1430 comprises a reinforcement beam 1274, and further comprises a reinforcement member in the form of a boxed reinforcement rib 1474. Boxed reinforcement rib 1474 comprises a pair of reinforcement beams 1484 that are bridged by a pair of reinforcement plates 1488 extending the length of the reinforcement beams 1484. Each reinforcement plate 1488 is secured to flanges of the reinforcement beams 1484. In the embodiment shown, each reinforcement beam 1484 is in the form of a steel I-beam. The reinforcement beams 1484 and the reinforcement plates 1488 define an interior cavity C which, in this embodiment, is filled with concrete for increasing the strength of the boxed reinforcement rib 1474. The web of each reinforcement beam 1484 comprises a plurality of apertures (not shown) therethrough that are positioned so as to align with apertures formed in the circumferential flanges of corrugated metal plates, enabling the boxed reinforcement rib 1474 to be secured to one or more corrugated metal plates.

Figure 10A:
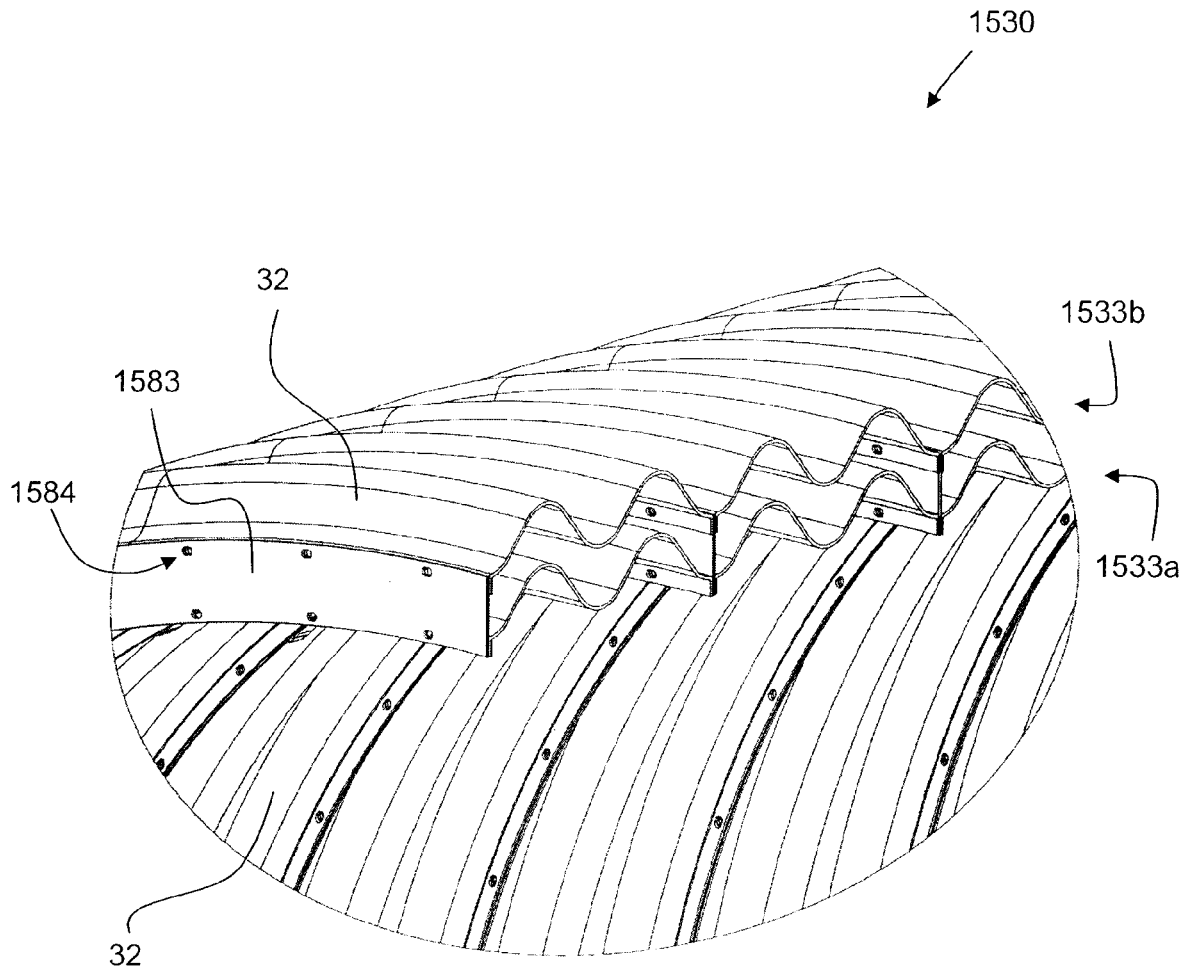
FIGS. 10*a* and 10*b* are perspective and sectional views, respectively, of portions of another embodiment of a metal archway.
Figure 10B:
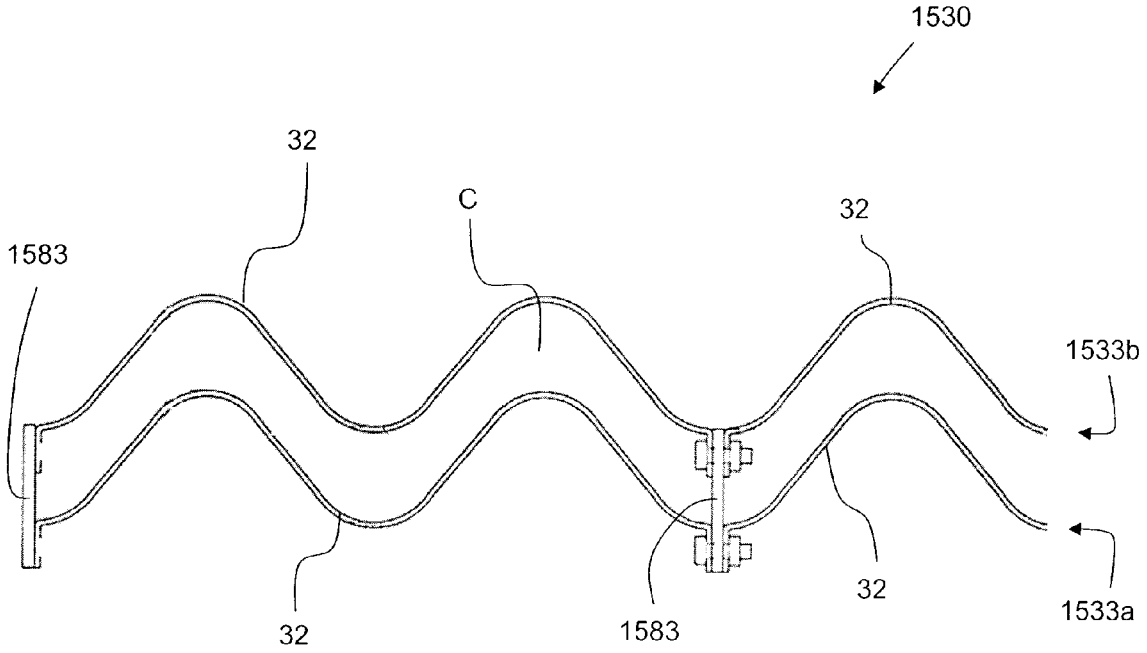

FIGS. 10*a* and 10*b* show portions of another embodiment of a metal archway, and which is generally indicated using reference numeral 1530. Metal archway 1530 is constructed from a plurality of interconnected structural corrugated metal plates 32 that are arranged in two similarly-oriented layers, so as to define a double layer having a first layer of plates 1533*a* and a second layer of plates 1533*b*. The plates 32 of the first layer 1533*a* are separated from the plates 32 of the second layer 1533*b* by a plurality of spacer plates 1583 positioned between the circumferential flanges 44 of adjacent plates 32. Each of the spacer plates 1583 has a plurality of apertures 1584 formed therein arranged in two rows, and which are positioned so as to align with apertures 46 of the circumferential flanges 44, enabling the spacer plates 1583 to be secured to the plates 32 using suitable fasteners. In this embodiment, the fasteners are bolts 48, although it will be appreciated that other suitable fasteners (welds, rivets, etc.) meeting the specific structural and load requirements can be used.

The plates 32 and spacer plates 1583 of the metal archway 1530 define a plurality of interior cavities C. One or more of the cavities may be filled with concrete so as to provide internal reinforcement of the metal archway 1530. Shear studs (not shown) may be attached to interior surfaces of the plates 32 for providing a shear bond at the metal-concrete interface.

As will be appreciated, the spacing of the opposing plates 32 is defined by the height of the spacer plates 1583. The height of the spacer plates 1583 may therefore be selected to provide a desired total volume of the interior cavities C, and in turn a desired amount of internal reinforcement of the metal archway 1530.

Figure 11:
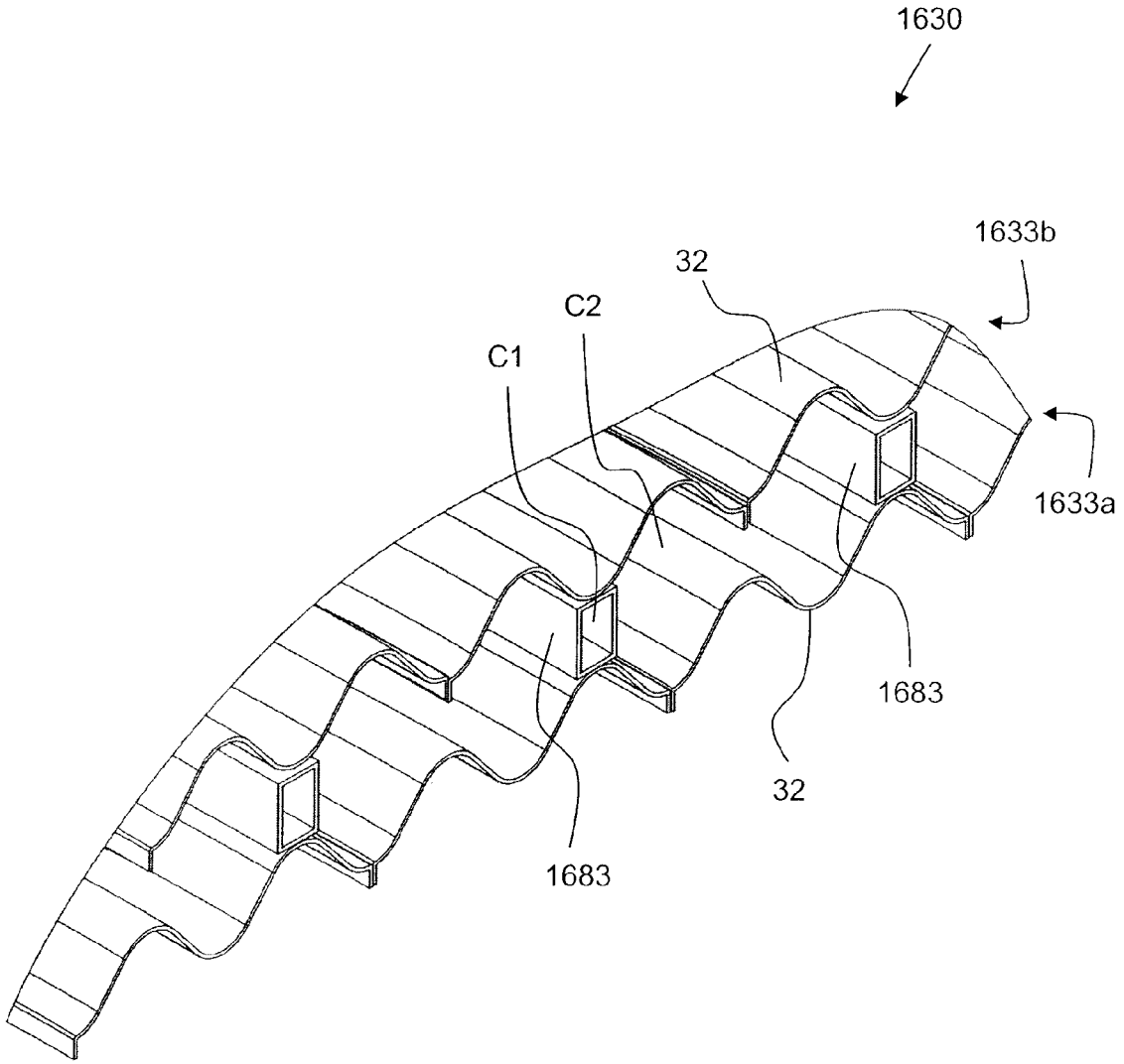
FIG. 11 is a perspective view of a portion of another embodiment of a metal archway.

FIG. 11 shows a portion of another embodiment of a metal archway, and which is generally indicated using reference numeral 1630. Metal archway 1630 is constructed from a plurality of interconnected structural corrugated metal plates 32, which are arranged so as to define a double layer having a first layer of plates 1633*a* and a second layer of plates 1633*b*. The plates 32 of the first layer 1633*a* are separated from the plates 32 of the second layer 1633*b* by a plurality of hollow structural sections 1683, which are secured to the crests of the plates 32 forming the first layer 1633*a* and to the troughs of the plates 32 forming the second layer 1633*b*. Each of the hollow structural sections 1683 is secured to the plates 32 by suitable fasteners (not shown). In this embodiment, the fasteners are bolts, although it will be appreciated that other suitable fasteners (welds, rivets, etc.) meeting the specific structural and load requirements can be used.

Each hollow structural section 1683 defines an interior cavity C1, and interior surfaces of the plates 32 and exterior surfaces of the hollow structural sections 1683 define a plurality of interior cavities C2 within the metal archway 1630. One or more of the cavities C1 and C2 may be filled with concrete so as to provide internal reinforcement of the metal archway 1630, and shear studs (not shown) may be attached to the interior surfaces of the plates 32 and/or to the interior and/or exterior surfaces of the hollow structural sections 1683 for providing a shear bond at the metal-concrete interface.

As will be appreciated, the spacing of the opposing plates 32 is defined by the height of the hollow structural sections 1683. The height of the hollow structural sections 1683 may therefore be selected to provide a desired total volume of the interior cavities C1 and C2, and in turn a desired amount of internal reinforcement of the metal archway 1630.

Figure 12:
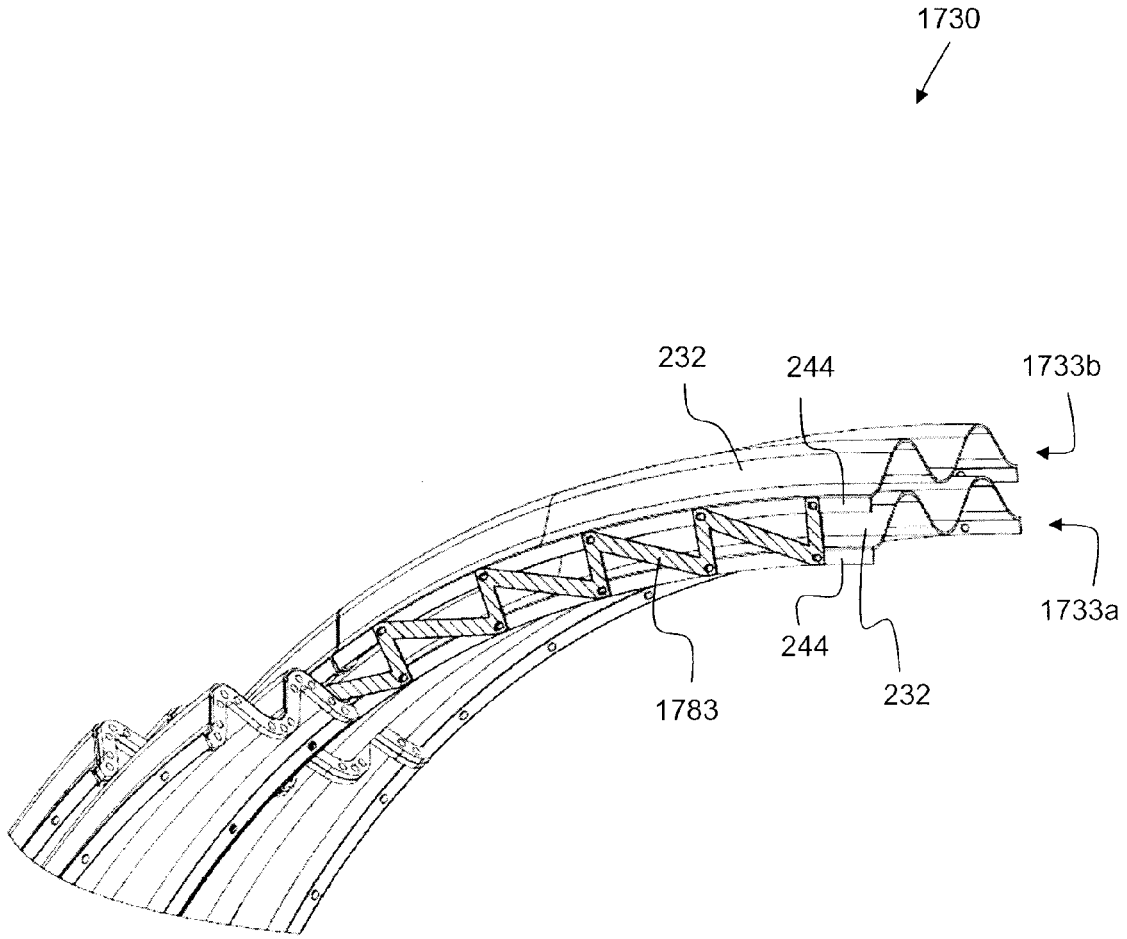
FIG. 12 is a perspective view of a portion of another embodiment of a metal archway.
Figure 13A:
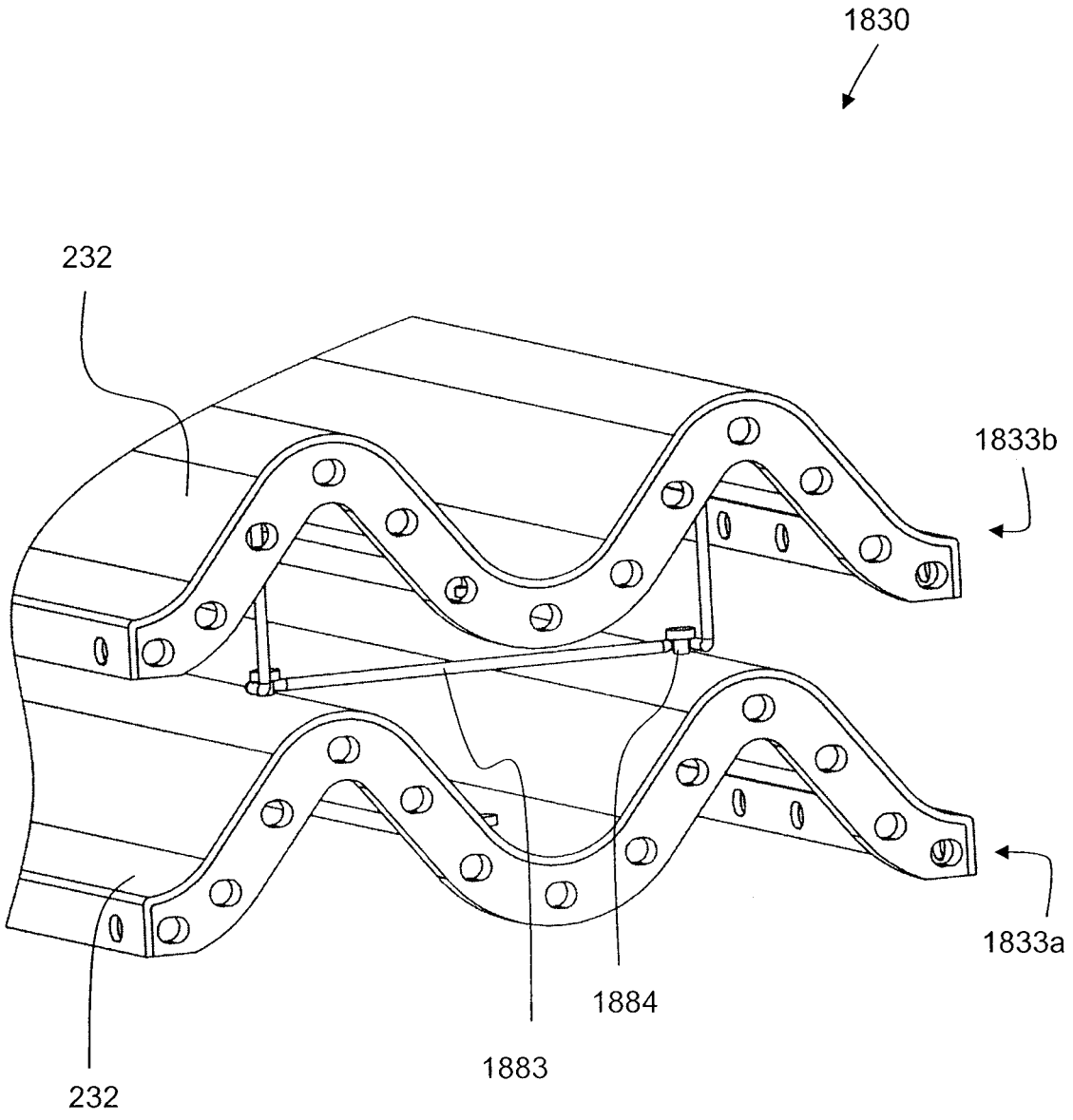
FIGS. 13*a* and 13*b* are perspective and front views, respectively, of a portion of another embodiment of a metal archway, showing a stand.
Figure 13B:
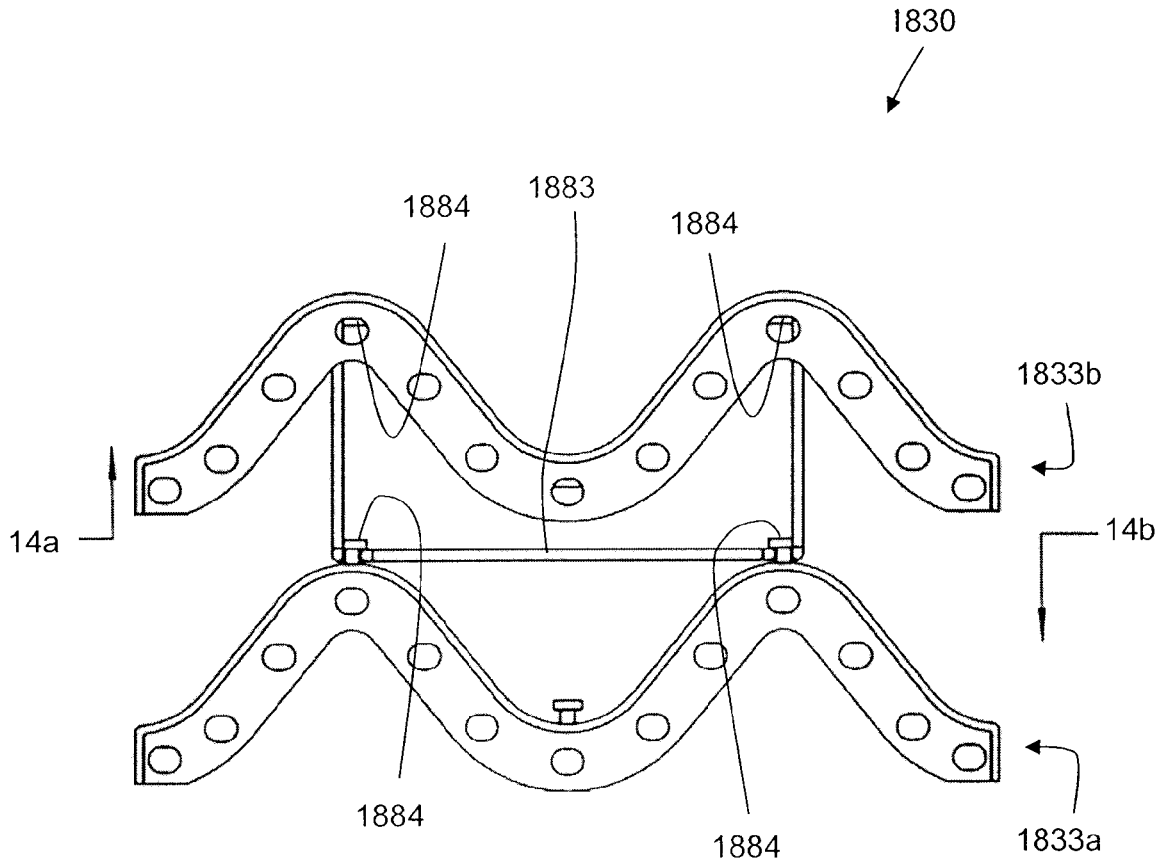
Figure 14A:
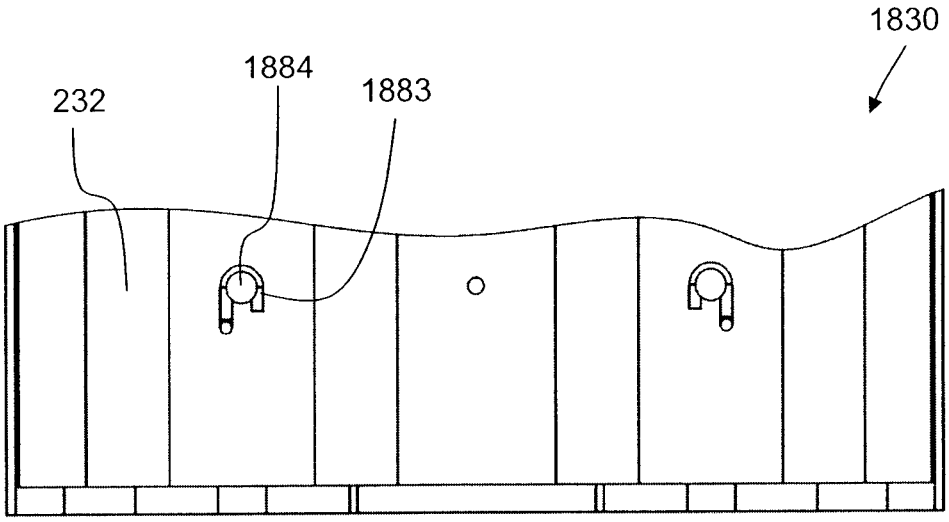
FIGS. 14*a* and 14*b* are sectional views of portions of the metal archway of FIG. 13*b*, taken along the indicated section lines.
Figure 14B:
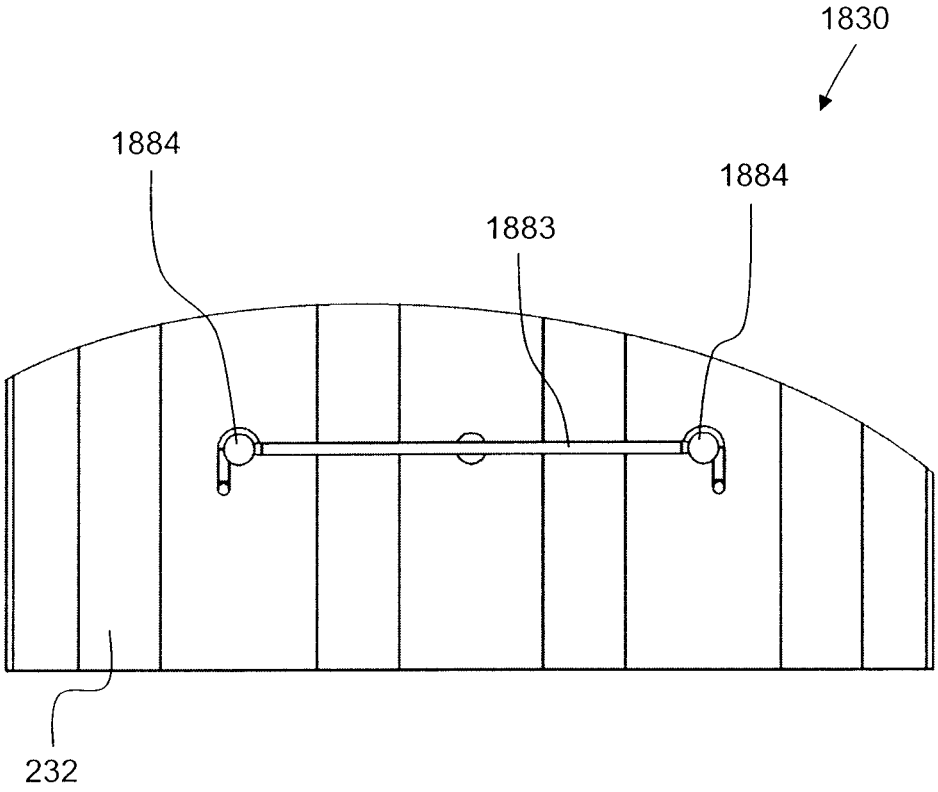

Other structures may be used to separate plates arranged within double layers. For example, FIG. 12 shows a portion of another embodiment of a metal archway, and which is generally indicated using reference numeral 1730. Metal archway 1730 is constructed from a plurality of interconnected structural corrugated metal plates 232, as described above and with reference to FIG. 6*b*. The corrugated metal plates 232 are arranged so as to define a double layer having a first layer of plates 1733*a* and a second layer of plates 1733*b*. The plates 232 of the first layer 1733*a* are separated from the plates 232 of the second layer 1733*b* by a plurality of web-shaped supports 1783 positioned between the circumferential flanges 244 of adjacent plates 232. Each of the web-shaped supports 1783 has a plurality of apertures formed therein, which are arranged in two rows and are positioned so as to align with apertures of the circumferential flanges 244, enabling the web-shaped supports 1783 to be secured to the plates 232 using suitable fasteners. In this embodiment, the fasteners are bolts, although it will be appreciated that other suitable fasteners (welds, rivets, etc.) meeting the specific structural and load requirements can be used.

Still other structures may be used to separate plates arranged within double layers. For example, FIGS. 13*a* to 14*b* show portions of another embodiment of a metal archway, and which is generally indicated using reference numeral 1830. Metal archway 1830 is constructed from a plurality of interconnected structural corrugated metal plates 232 which are arranged so as to define a double layer having a first layer of plates 1833*a* and a second layer of plates 1833*b*. Shear studs 1884 are attached to the interior surfaces of the plates 232. The plates 232 of the first layer 1833*a* are separated from the plates 232 of the second layer 1833*b* by a plurality of spacer stands 1883. Each spacer stand 1883 is formed of structural rod, such as for example steel reinforcement bar, and engages the shear studs 1884 so as to secure the plates 232 of the first layer 1833*a* to the plates 232 of the second layer 1833*b*. Additionally, spacer stands 1883 provide points from which plates 232 of the first layer 1833*a* may be hung during assembly, for facilitating assembly of the metal archway 1830.

Figure 15:
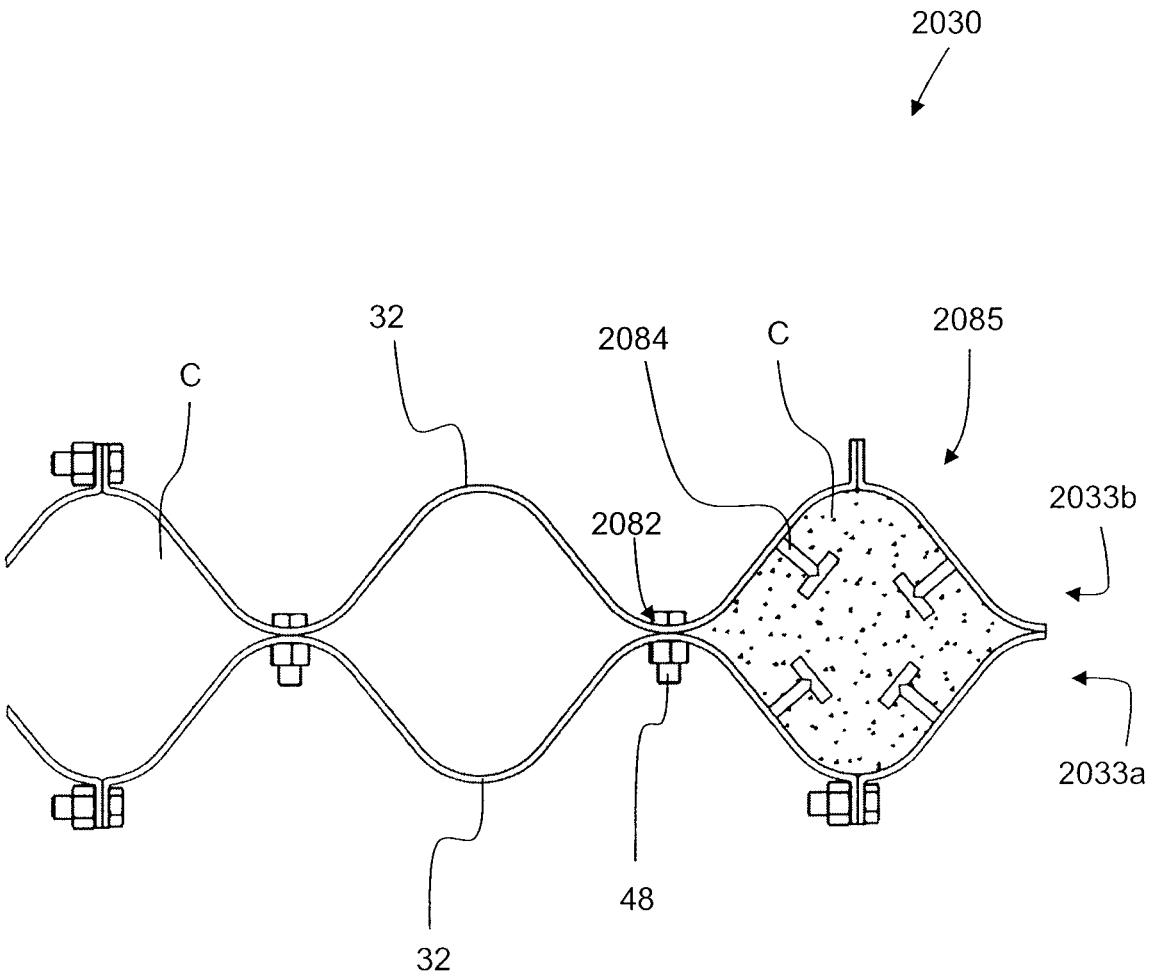
FIG. 15 is a sectional view of a portion of another embodiment of a metal archway.

FIG. 15 shows a portion of another embodiment of a metal archway, and which is generally indicated using reference numeral 2030. Metal archway 2030 is constructed from a plurality of interconnected structural corrugated metal plates 32 that are arranged and in two opposingly-oriented layers within the metal archway 2030, so as to define a double layer having a first layer of plates 2033*a* and a second layer of plates 2033*b*. In the embodiment shown, the plates of the first layer 2033*a* are inverted, such that the troughs of the plates 32 forming the first layer 2033*a* abut against the troughs of the plates 32 forming the second layer 2033*b*. A plurality of apertures 2082 is formed generally along the centers of the troughs, with each aperture 2082 being sized to receive a respective fastener for enabling opposing plates 32 to be secured to each other. In this embodiment, the fasteners are bolts 48, although it will be appreciated that other suitable fasteners (welds, rivets, etc.) meeting the specific structural and load requirements can be used.

In this embodiment, the metal archway 2030 further comprises cavities C formed between opposing pairs of troughs. In the embodiment shown, one of the cavities C is filled with concrete so as to provide an internal reinforcement rib 2085. Shear studs 2084 are attached to interior surfaces of the plates 32 defining the cavities C for providing a shear bond at the metal-concrete interface.

Figure 16:
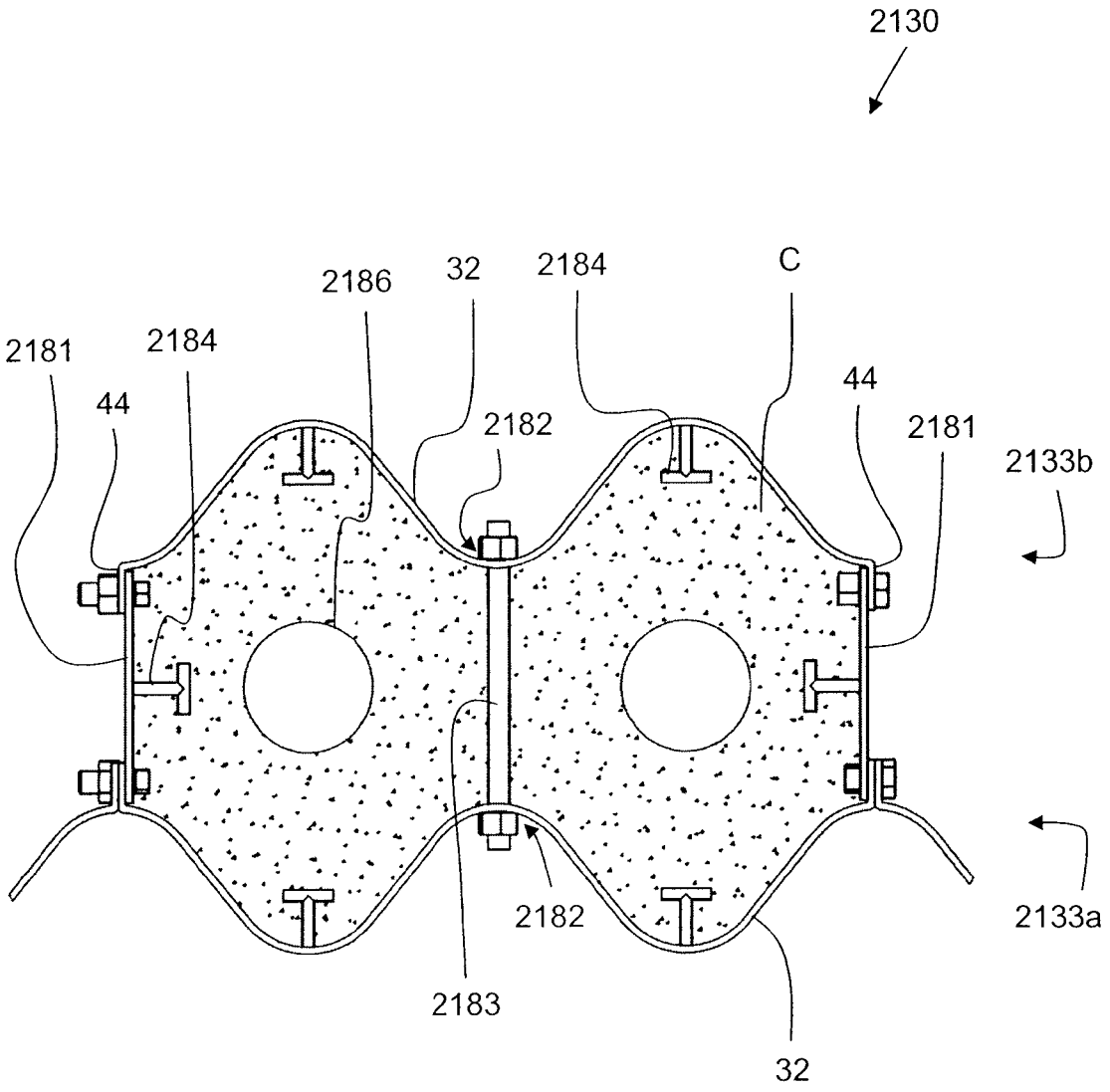
FIG. 16 is a sectional view of a portion of another embodiment of a metal archway.

FIG. 16 shows still another embodiment of a portion of a metal archway, and which is generally indicated using reference numeral 2130. Similar to metal archway 2030 described above and with reference to FIG. 15, metal archway 2130 is constructed from a plurality of interconnected structural corrugated metal plates 32 that are arranged in two opposingly-oriented layers within the metal archway 2130, so as to define a double layer having a first layer 2133*a* of plates and a second layer 2133*b* of plates. In the embodiment shown, the plates 32 of the first layer 2133*a* are separated from the plates 32 of the second layer 2133*b* by a plurality of spacer plates 2181 secured to the circumferential flanges 44 of the opposing plates 32. As will be appreciated, the spacing of the opposing plates 32 is defined by the height of the spacer plates 2181, and the height of the spacer plates 2181 may therefore be selected to provide both a desired degree of reinforcement and a desired confinement volume. A plurality of apertures 2182 is formed generally along the centers of the troughs, with each aperture 2182 being sized to receive a respective fastener for enabling opposing plates 32 to be secured to each other. In this embodiment, the fasteners are bolts 2183, although it will be appreciated that other suitable fasteners (welds, rivets, etc.) meeting the specific structural and load requirements can be used.

The opposing plates 32 and plates 2181 of the metal archway 2130 define a plurality of interior cavities C, with one or more of the cavities being filled with concrete so as to provide internal reinforcement of the metal archway. Shear studs 2184 are attached to interior surfaces of the plates 32 and the spacer plates 2183 for providing a shear bond at the metal-concrete interface. In this embodiment, tubular ducts 2186 are also provided within the cavity filled with concrete.

Figure 17A:
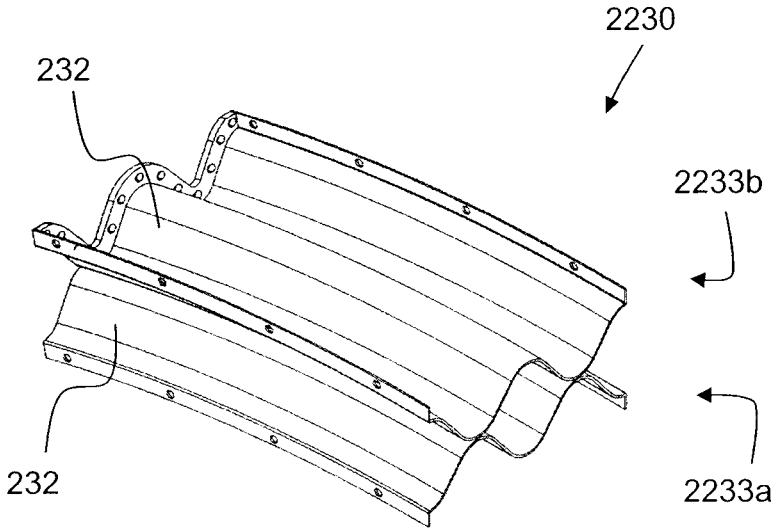
FIGS. 17*a* and 17*b* are perspective, schematic views of portions of other embodiments of metal archways, showing different spacing between corrugated metal plates.
Figure 17B:
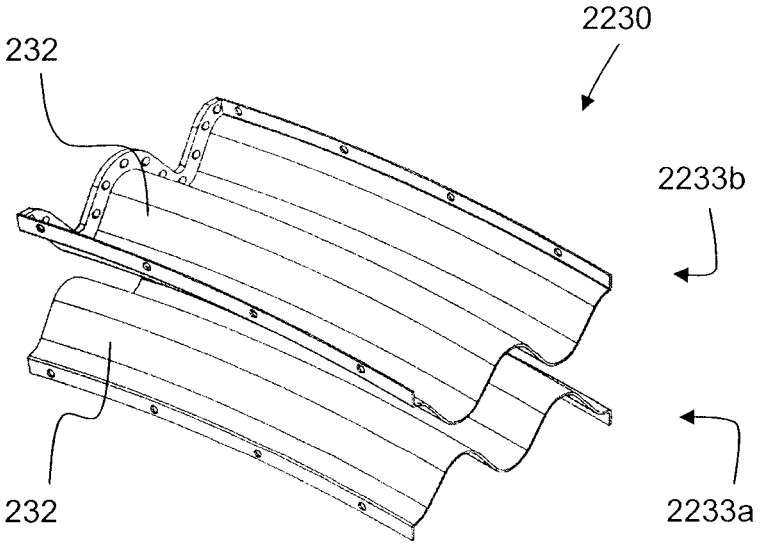

The structural corrugated metal plates arranged in double layers within the metal archways are not limited to the configurations shown above, and in other embodiments, the metal archway may alternatively have a different configuration. For example, FIGS. 17*a* and 17*b* schematically show portions of still another embodiment of a metal archway 2230 that is constructed from a plurality of interconnected structural corrugated metal plates 232. The corrugated metal plates 232 are arranged in two opposingly-oriented layers within the metal archway 2230, so as to define a double layer having a first layer 2233*a* of plates and a second layer 2233*b* of plates. In the example shown in FIG. 17*a*, the plates of the second layer 2233*b* are inverted. As a result, the plates of the first layer 2233*a* are positioned such that the crests of the plates 232 forming the first layer 2233*a* abut against the crests of the plates 232 forming the second layer 2233*b*. In the example shown in FIG. 17*b*, the plates of the first layer 2233*a* are positioned such that the crests of the plates 232 forming the first layer 2233*a* are aligned with, but spaced from, the crests of the plates 232 forming the second layer 2233*b*. As will be appreciated, the spacing of the opposing plates 232 may be defined by a height of any suitable spacer member (not shown), and the height of each spacer member may be selected to provide a desired confinement volume, and in turn, a desired amount of reinforcement of the metal archway 2230.

Figure 18A:
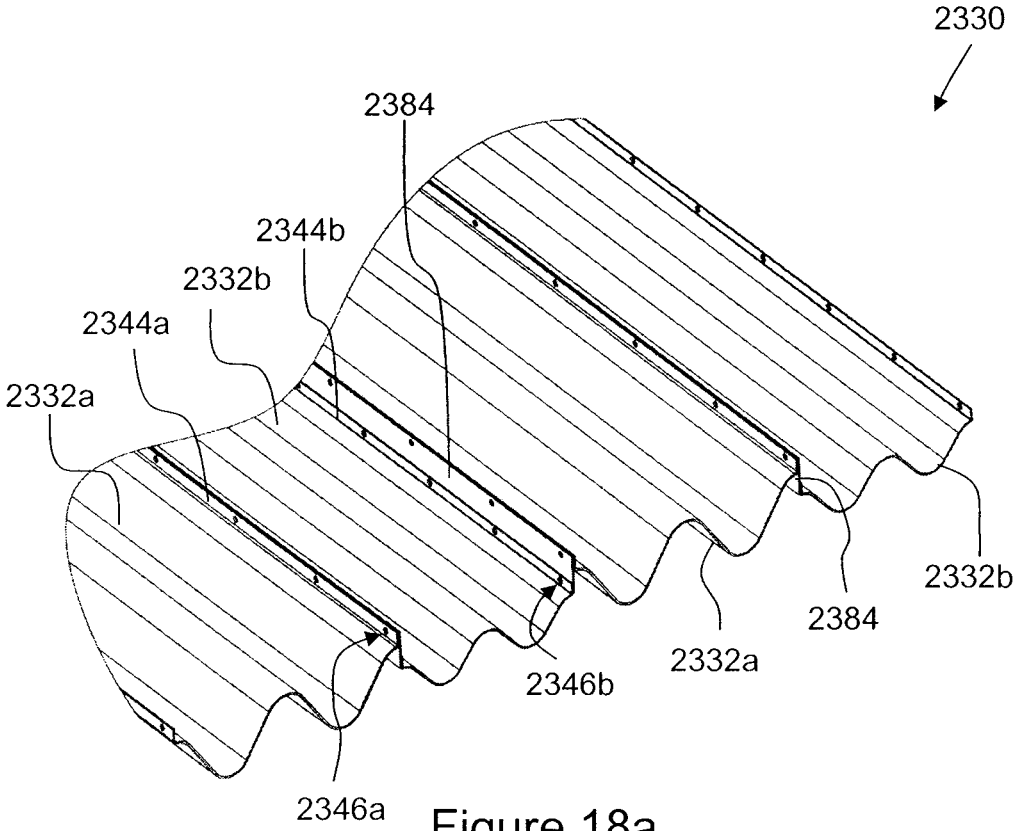
FIGS. 18*a* and 18*b* are perspective and sectional views, respectively, of portions of another embodiment of a metal archway.
Figure 18B:
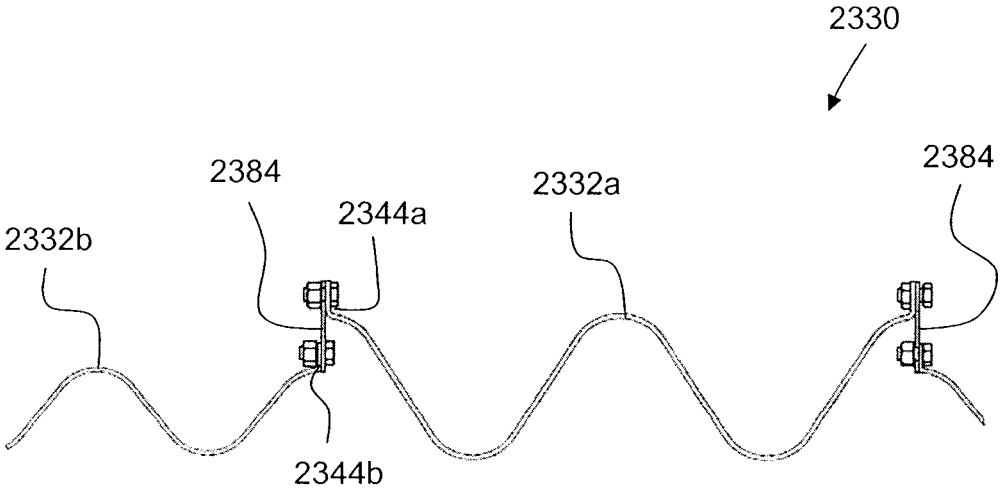

As will be appreciated, the circumferential and longitudinal flanges of the corrugated metal plates advantageously allow adjacent corrugated metal plates of different profile, such as different corrugation pitch and/or different corrugation depth, to be secured to each other in a facile manner, and without the need to form lap joints by partially overlapping neighbouring plates. For example, FIGS. 18*a* and 18*b* show portions of another embodiment of a metal archway 2322 comprising a plurality of corrugated metal plates 2332*a* and 2332*b*, with plates 2332*a* and plates 2332*b* having different respective profiles. In the embodiment shown, the pitch and the depth of plate 2332*a* are greater than the pitch and the depth of plate 2332*b*. Each of the corrugated metal plates 2332*a* and 2332*b* is generally similar to plate 32 described above and with reference to FIGS. 3 to 5, and has a pair of circumferential edges that are generally parallel to the longitudinal axes of the crests and the troughs. Extending generally the length of the circumferential edge of each corrugated metal plate 2332*a* is a circumferential flange 2344*a* having a plurality of apertures 2346*a* formed therein, with each aperture 2346*a* being configured to receive a respective fastener. Similarly, extending generally the length of the circumferential edge of each corrugated metal plate 2332*b* is a circumferential flange 2344*b* having a plurality of apertures 2346*b* formed therein, with each aperture 2346*b* being configured to receive a respective fastener. In the embodiment shown, the positioning of the apertures 2346*a* and 2346*b* are different.

In the embodiment shown, adjacent plates 2332*a* and 2332*b* are secured using an intermediate plate 2384. The intermediate plate 2384 has two (2) rows of apertures formed therein, with the apertures of each row having the same positioning as apertures 2346*a* and 2346*b* of the plates 2332*a* and 2332*b*. The two rows of apertures of the intermediate plate 2384 are spaced by an offset distance. As will be appreciated, the intermediate plate 2384 effectively serves as an adapter for allowing adjacent plates 2332*a* and 2332*b* to be secured to each other.

Figure 19:
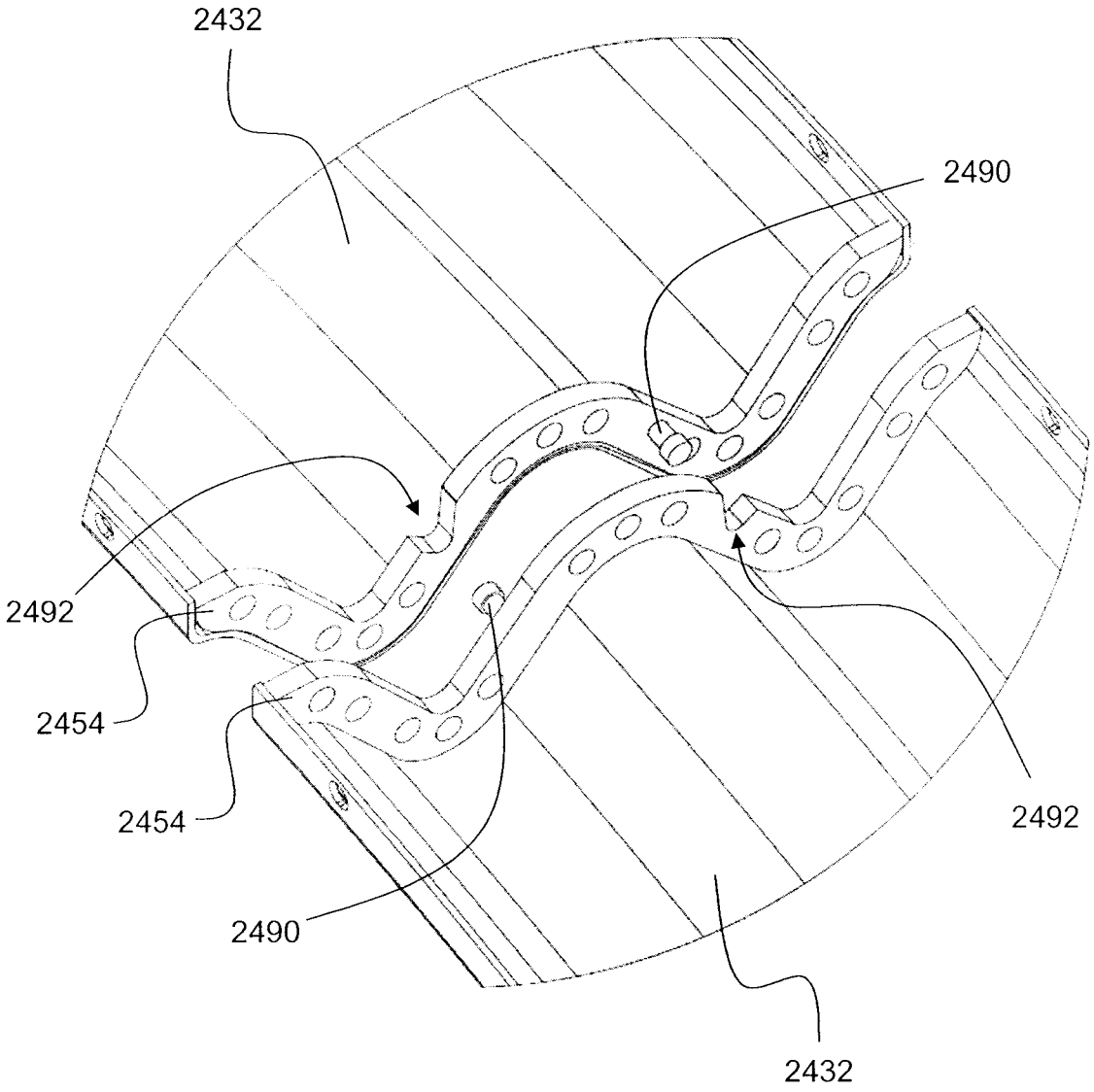
FIG. 19 is a perspective view of portions of another embodiment of a corrugated metal plate for use in the metal archway of FIG. 2.

To facilitate assembly of the metal archway, the flanges of the corrugated metal plate may comprise alignment features. For example, FIG. 19 shows another embodiment of corrugated metal plates for use in the metal archway 30, each plate generally referred to using reference numeral 2432. Each plate 2432 is generally similar to plate 232 described above and with reference to FIG. 6*b*, and comprises a longitudinal flange 2454 extending the length of each longitudinal edge. Each longitudinal flange 2454 comprises a pin 2490 protruding outwardly from the flange 2454. Each flange 2454 also comprises a notch 2492, which is sized and positioned to accommodate the pin 2490 extending from an opposing flange 2454 of an adjacent plate 2432, as shown in FIG. 19. Similarly, the pin 2490 protruding outwardly from the flange 2454 is positioned to be received in a notch 2492 of an opposing flange 2454 of an adjacent plate 2432. Thus, although not shown but as will be understood, the relative positions of the pins 2490 and notches 2492 are generally reversed for the longitudinal flanges 2454 at opposite ends of a corrugated metal plate 2432. In this manner, the pin 2490 of a first plate 2432 engages the notch 2492 of a second plate 2432. Each flange 2454 further has a plurality of apertures formed therein, with each aperture being configured to receive a respective fastener (not shown) for allowing adjacent plates 2432 to be secured to each other. As will be appreciated, the pin 2490 and notch 2492 advantageously ensure that adjacent plates 2432 are correctly aligned relative to each other prior to being secured with fasteners.

Although alignment features comprising pins and notches have been described, mating formations of alignment features having other configurations may be used. For example, in other embodiments, each plate may alternatively comprise one longitudinal flange comprising one (1) or more pins only, and no notches, and one longitudinal flange comprising a corresponding one (1) or more notches only, and no pins. As will be understood, in addition to ensuring that adjacent plates are correctly aligned relative to each other prior to being secured with fasteners, such a configuration would also ensure that adjacent plates are arranged in a correct order relative to each other prior to being secured with fasteners.

Figure 20:
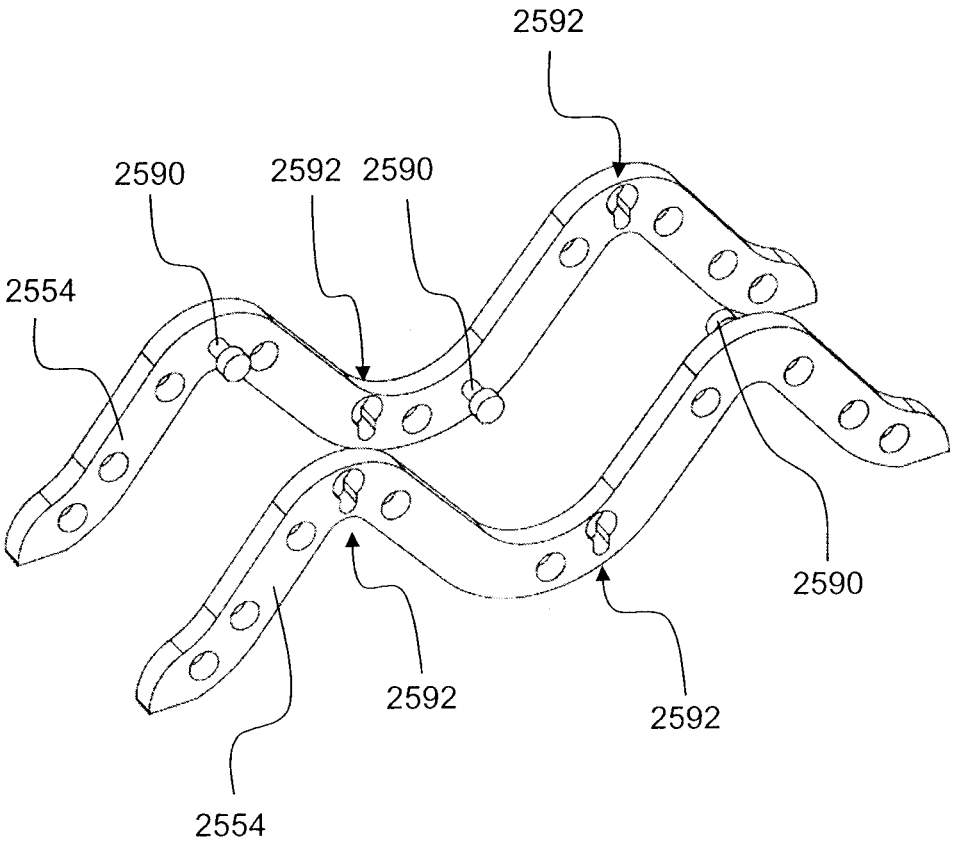
FIG. 20 is a perspective view of longitudinal flanges of abutting corrugated metal plates of another embodiment for use in the metal archway of FIG. 2.

Still other configurations are possible. For example, FIG. 20 shows a pair of longitudinal flanges of abutting corrugated metal plates of another embodiment, each longitudinal flange generally referred to using reference numeral 2554. Each longitudinal flange 2554 comprises two (2) pins 2590 protruding outwardly from the flange 2554. Each flange 2554 also comprises two (2) slots 2592, which are sized and positioned to accommodate the pins 2590 extending from an opposing flange 2554 of an adjacent plate, as shown in FIG. 20. Similarly, each pin 2590 protruding outwardly from the flange 2554 is positioned to be received in a slot 2592 of an opposing flange 2554 of an adjacent plate. Thus, although not shown but as will be understood, the relative positions of the pins 2590 and slots 2592 are generally reversed for the longitudinal flanges 2554 at opposite ends of a corrugated metal plate. Each flange 2554 further has a plurality of apertures formed therein, with each aperture being configured to receive a respective fastener (not shown) for allowing adjacent plates to be secured to each other. As will be appreciated, the pins 2590 and slots 2592 advantageously ensure that adjacent plates are correctly aligned relative to each other prior to being secured with fasteners. Additionally, and as will be appreciated, the pins 2590 and slots 2592 advantageously allow one plate to be supported by another plate prior to, or during, insertion of fasteners, thereby facilitating the assembly of the metal archway, or any other structure assembled from the plates.

Figure 21:
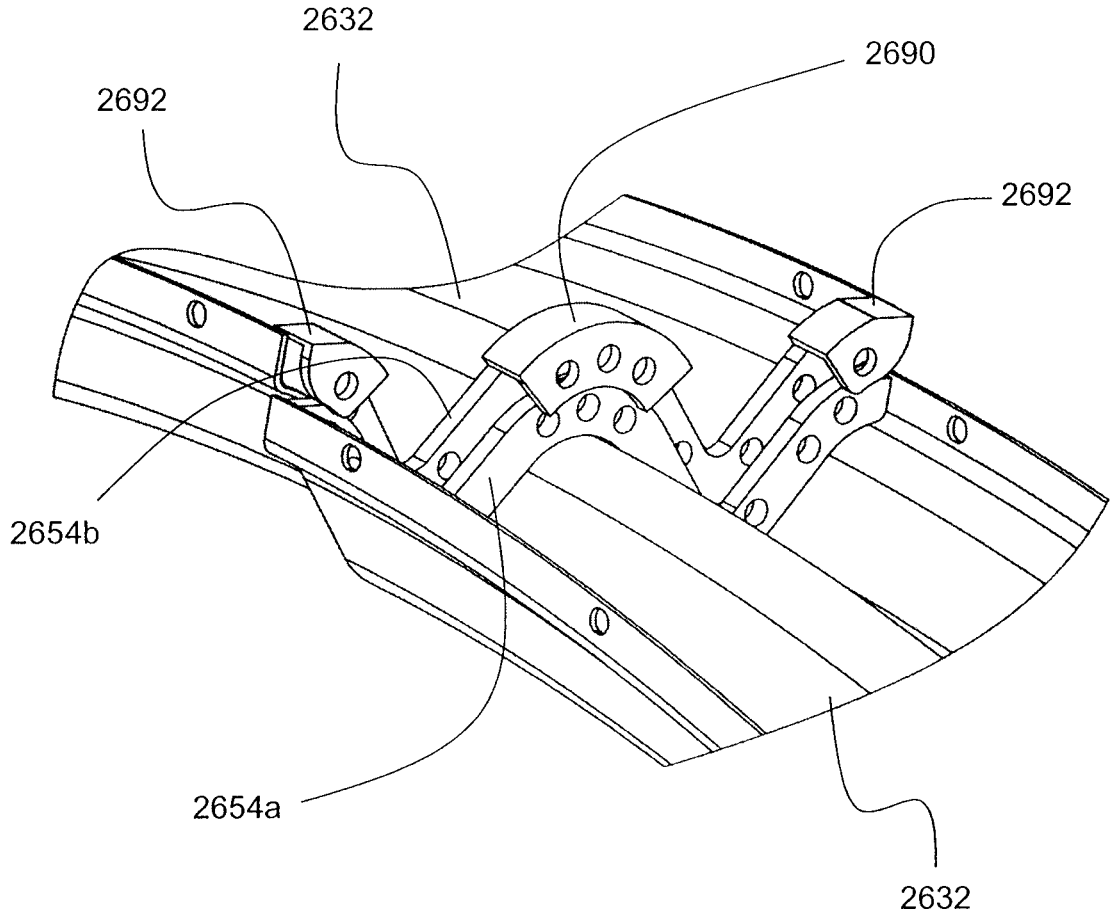
FIG. 21 is a perspective view of portions of another embodiment of a corrugated metal plate for use in the metal archway of FIG. 2.

Still other configurations are possible. For example, FIG. 21 shows another embodiment of a corrugated metal plate, which is generally referred to using reference numeral 2632. Plate 2632 is generally similar to plate 232 described above and with reference to FIG. 6*b*, and comprises a longitudinal flange 2654*a* extending the length of a first longitudinal edge and a longitudinal flange 2654*b* extending the length of a second longitudinal edge. Longitudinal flange 2654*a* is generally similar to longitudinal flange 254 of plate 232. Longitudinal flange 2654*b* is also generally similar to longitudinal flange 254 of plate 232, but further comprises a central alignment bracket 2690 and two (2) end alignment brackets 2692. The central alignment bracket 2690 and end alignment brackets 2692 are sized and positioned for engaging the longitudinal flange 2654*a* of an adjacent, abutting plate 2632. Each of the flanges 2654*a* and 2654*b* and the alignment brackets 2690 and 2692 has one or more apertures formed therein, with each aperture being configured to receive a respective fastener (not shown) for allowing adjacent plates 2632 to be secured to each other. As will be appreciated, the alignment brackets 2690 and 2692 advantageously ensure that adjacent plates 2632 are correctly aligned relative to each other prior to being secured with fasteners.

Figure 22:
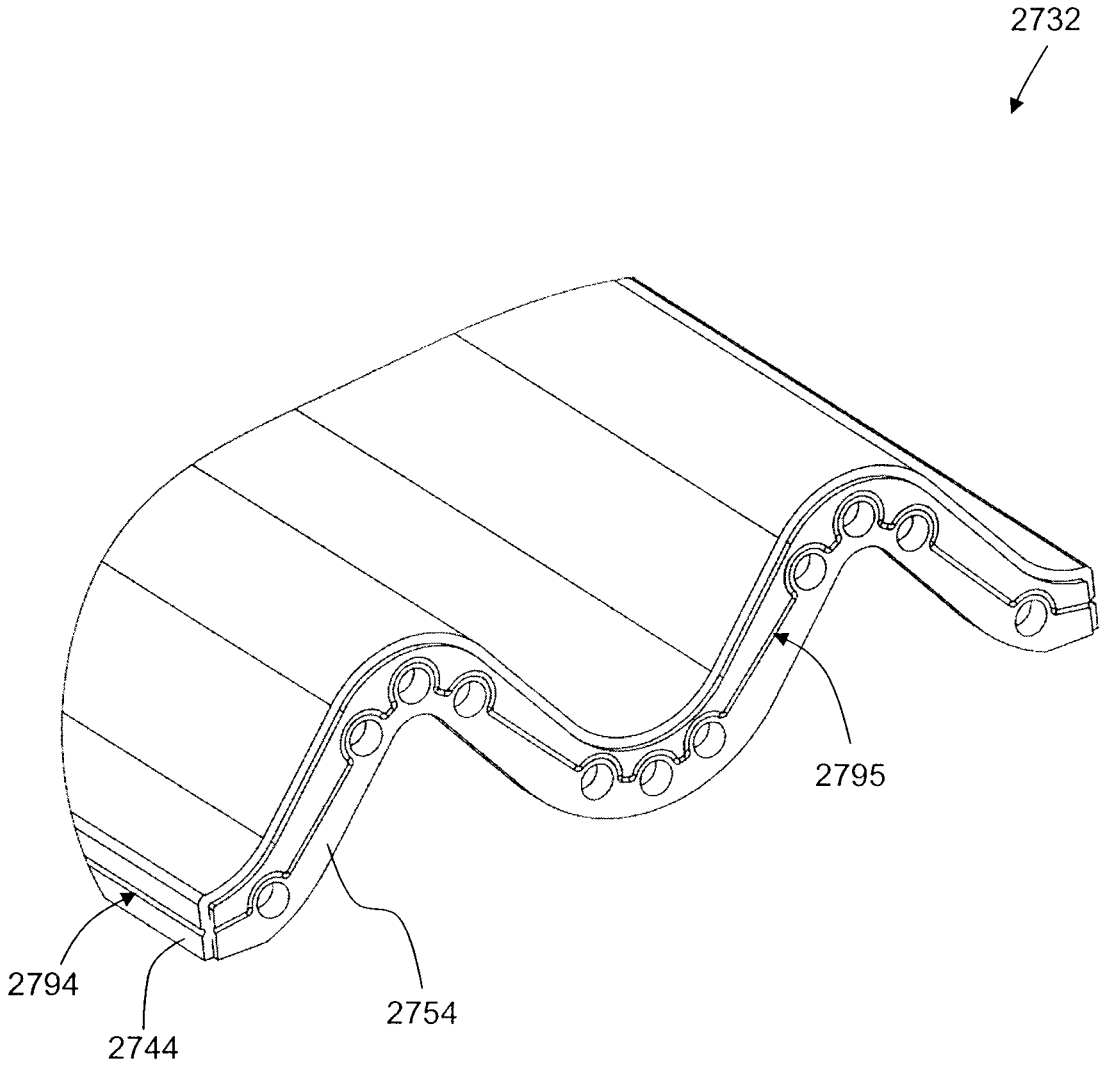
FIG. 22 is a perspective view of a portion of another embodiment of a corrugated metal plate for use in the metal archway of FIG. 2.

In other embodiments, the flanges of the corrugated metal plates may comprise features for accommodating other forms of sealant strip. For example, FIG. 22 shows another embodiment of a corrugated metal plate, which is generally indicated by reference numeral 2732. Corrugated metal plate 2732 is generally similar to plate 232 described above and with reference to FIG. 6*b*, and comprises a circumferential flange 2744 extending generally the length of each circumferential edge. Plate 2732 also comprises a longitudinal flange 2754 extending generally the length of each longitudinal edge, and following the contour of the crests and troughs. Along the length of each circumferential flange 2744 extends a groove 2794, which is sized and shaped to accommodate a longitudinally-shaped gasket (not shown). Similarly, along the length of each longitudinal flange 2754 extends a groove 2795 which is sized and shaped to accommodate a suitably-shaped gasket (not shown). As will be understood, when circumferential flanges 2744 of adjacent plates 2732 are in abutment, grooves 2794 provide a cavity (not shown) in which the gasket is retained. Similarly, when longitudinal flanges 2754 of adjacent plates 2732 are in abutment, grooves 2795 provide a cavity (not shown) in which the gasket is retained. Each gasket provides a seal against the flow of fluid, such as for example rain water or groundwater, through joints formed between the adjacent plates 2732. The gaskets advantageously provide general water-tightness to a structure assembled from the plates 2732, and also advantageously enable the structure to maintain fluid pressure.

Figure 23A:
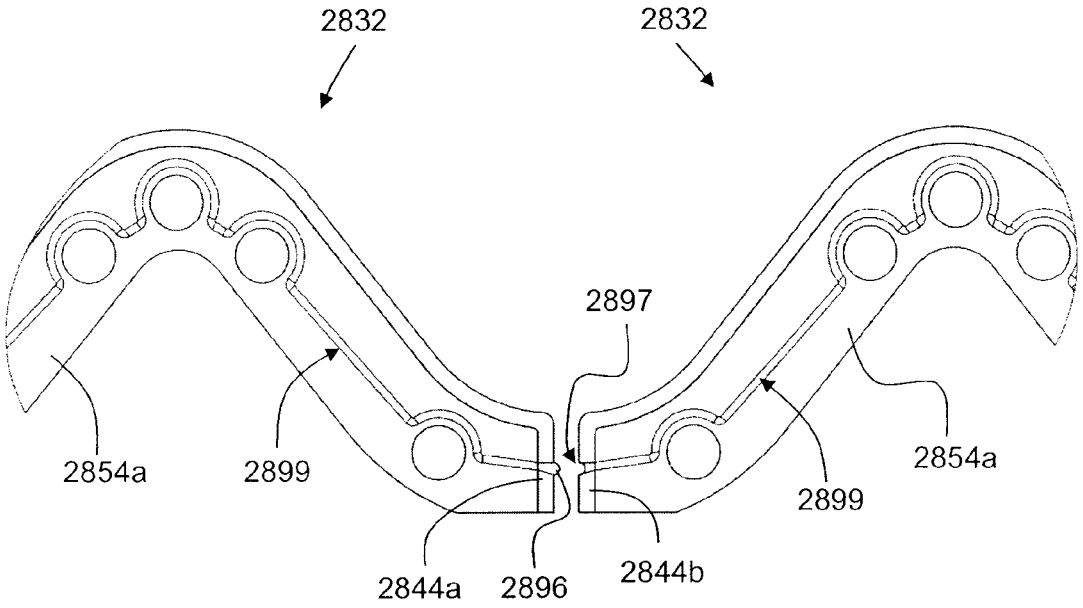
FIGS. 23*a* and 23*b* are sectional views of portions of another embodiment of a corrugated metal plate, showing adjacent corrugated metal plates in non-abutting and abutting positions, respectively.
Figure 23B:
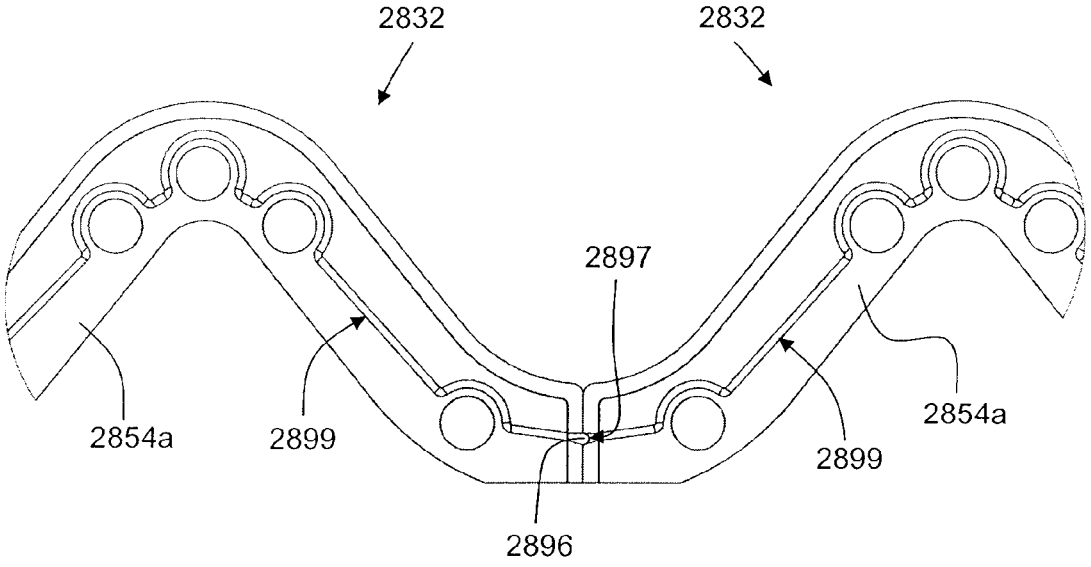

The flanges of the corrugated metal plates may comprise still other features for accommodating other forms of sealant strip. For example, FIGS. 23*a* and 23*b* show another embodiment of a corrugated metal plate, which is generally indicated by reference numeral 2832. Plate 2832 is generally similar to plate 232 described above and with reference to FIG. 6*b*, and comprises circumferential flanges 2844*a* and 2844*b* extending generally the length of opposing circumferential edges thereof. Plate 2832 also comprises longitudinal flanges 2854*a* and 2854*b* (not shown) extending generally the length of opposing longitudinal edges thereof, and following the contour of the crests and troughs. Along the length of circumferential flange 2844*a* extends a longitudinally-shaped projection 2896, while along the length of circumferential flange 2844*b* extends a longitudinally-shaped groove 2897, which is sized and shaped to accommodate both the projection 2896 of an adjacent plate as well as a longitudinally-shaped gasket (not shown). Similarly, along the length of longitudinal flange 2854*a* extends a projection 2899. Along the length of longitudinal flange 2854*b* (not shown) extends a groove (not shown) which is sized and shaped to accommodate both the projection 2899 of an adjacent plate as well as a suitably-shaped gasket (not shown). As will be understood, when circumferential flanges 2844*a* and 2844*b* of adjacent plates 2832 are in abutment, projections 2896 and grooves 2897 provide a cavity (not shown) in which the gasket is retained. Similarly, when longitudinal flanges 2854*a* and 2854*b* (not shown) of adjacent plates 2832 are abutted against each other, projections 2899 and grooves (not shown) provide a cavity (not shown) in which the gasket (not shown) is retained. Each gasket provides a seal against the flow of fluid, such as rain water or groundwater, through joints formed between the adjacent plates 2832. The gaskets thereby advantageously provide general water-tightness to a structure assembled therefrom, and also advantageously enable the structure to maintain fluid pressure. Additionally, and as will be appreciated, the projections and grooves of plate 2832 also advantageously ensure that adjacent plates 2832 are correctly positioned relative to each other prior to securing with fasteners.

Figure 24:
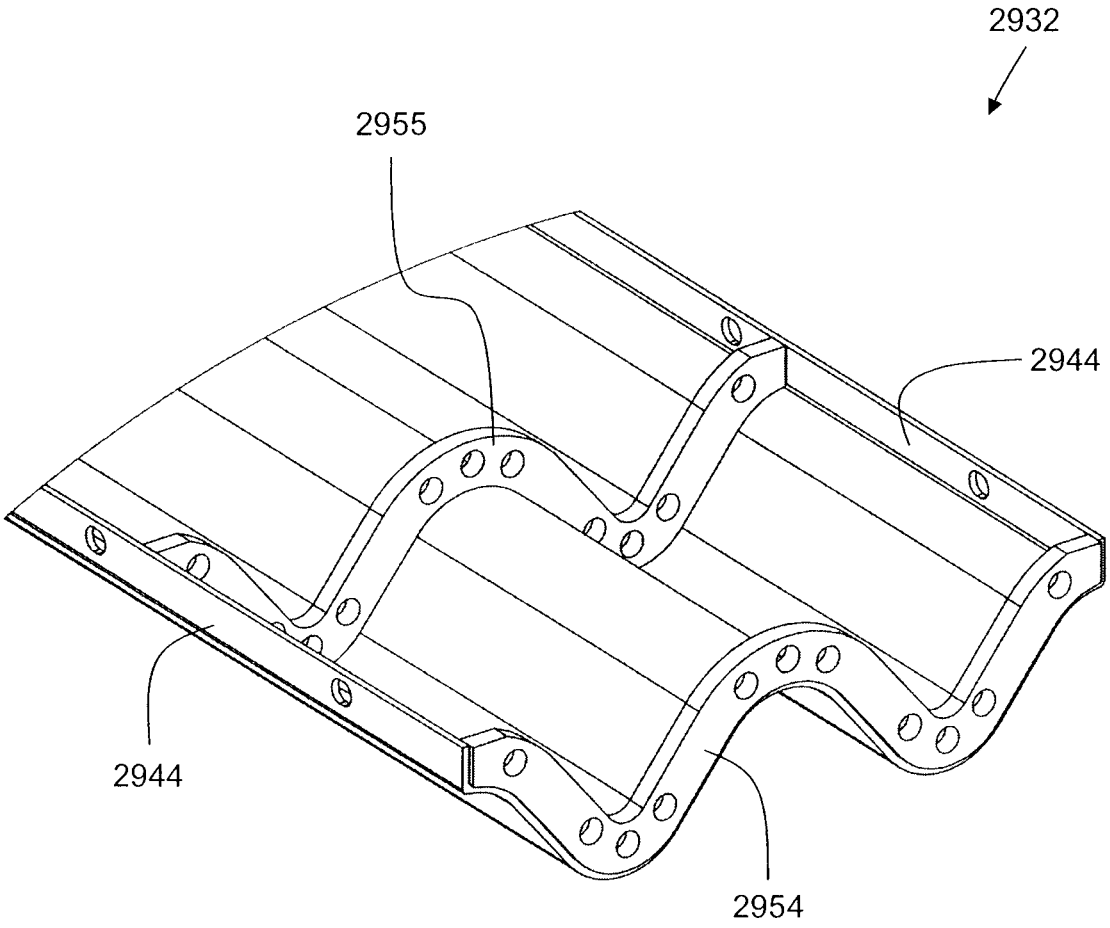
FIG. 24 is a perspective view of a portion of another embodiment of a corrugated metal plate for use in the metal archway of FIG. 2.

Other configurations are possible. For example, FIG. 24 shows an embodiment of a corrugated metal plate, which is generally indicated by reference numeral 2932. Corrugated metal plate 2932 is generally similar to plate 232 described above and with reference to FIG. 6*b*, and comprises a circumferential flange 2944 extending generally the length of each circumferential edge. Plate 2932 also comprises a longitudinal flange 2954 extending generally the length of each longitudinal edge, and following the contour of the crests and troughs. Plate 2932 also comprises a stiffener flange 2955 intermediate the longitudinal edges, and extending between the circumferential flanges 2944. As will be appreciated, the stiffener flange significantly increases the strength of the corrugated metal plate 2932, as compared to corrugated metal plates that do not comprise stiffener flanges.

Figure 25:
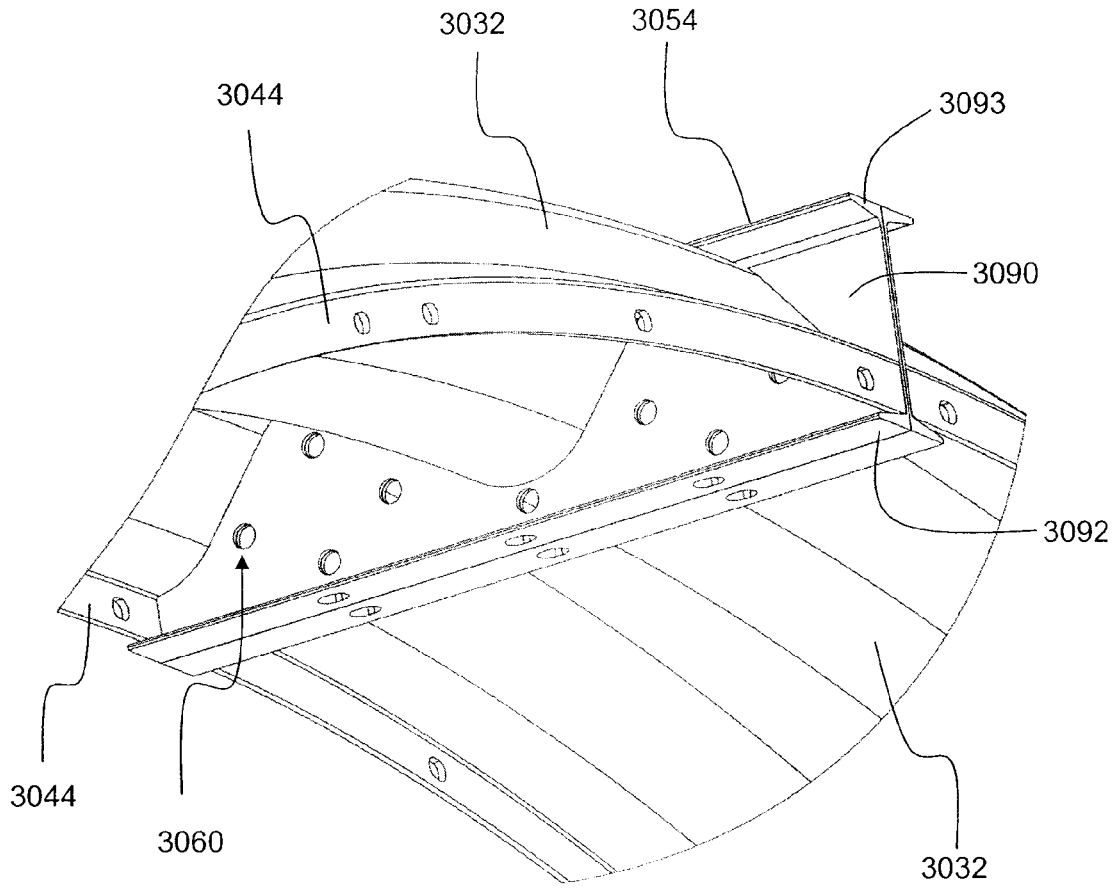
FIG. 25 is a perspective view of portions of abutting corrugated metal plates of another embodiment for use in the metal archway of FIG. 2.

Although in embodiments described above, the longitudinal flanges follow the contour of the crests and troughs, in other embodiments, the longitudinal flanges may alternatively not follow the contour of the crests and troughs and therefore may alternatively be rectangularly shaped, or otherwise. For example, FIG. 25 shows portions of abutting corrugated metal plates of another embodiment for use in the metal archway 30, each corrugated metal plate being generally indicated by reference numeral 3032. Plate 3032 is generally similar to plate 32 described above and with reference to FIGS. 3 to 5, but comprises a longitudinal flange 3054 in the form of a C-beam extending the length of each longitudinal edge. Each longitudinal flange 3054 comprises a central web 3090 that bridges a first flange 3092 having an inner surface that is positioned to support circumferential flanges 3044 of the plate 3032, and a second flange 3093 having an inner surface that abuts the crests of the plate 3032. The longitudinal flange 3054 further has a plurality of apertures 3060 formed therein, with each aperture 3060 being configured to receive a respective fastener (not shown) allowing adjacent plates 3032 to be secured to each other. As will be understood, as the circumferential flanges 3044 are supported by the first flange 3092, the plate 3032 provides improved distribution of loads throughout the overhead structure 3022.

Figure 26:
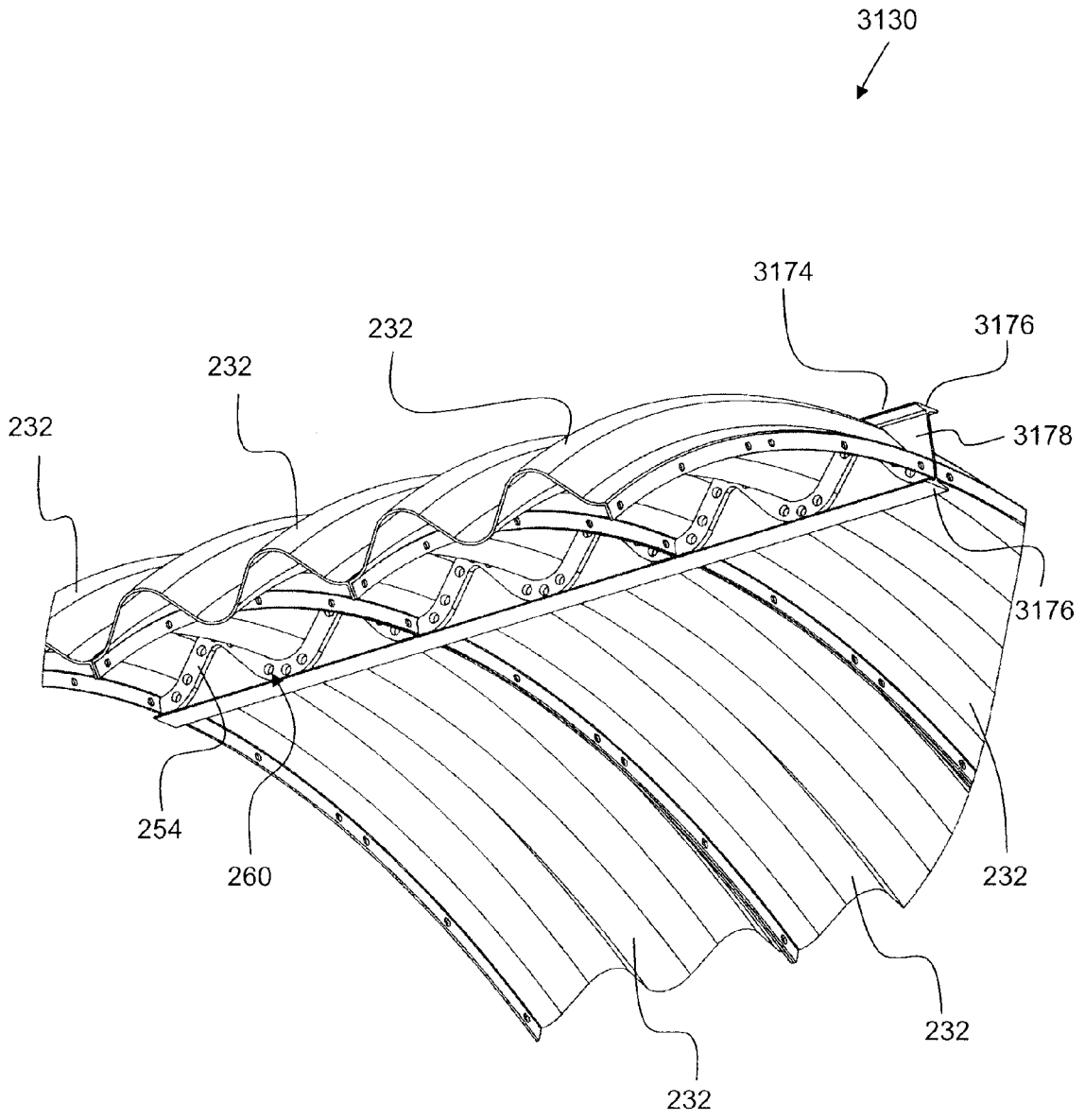
FIG. 26 is a perspective view of a portion of another embodiment of a metal archway.

To provide additional support and to increase the load carrying capabilities of the overhead structure, one or more longitudinal reinforcement members can be secured to the metal archway. For example, FIG. 26 shows another embodiment of a metal archway, which is generally indicated using reference numeral 3130. Metal archway 3130 is constructed from a plurality of interconnected structural corrugated metal plates 232, as described above and with reference to FIG. 6*b*. Metal archway 3130 comprises a longitudinal reinforcement member 3174 in the form of steel I-beam. Member 3174 comprises a pair of flanges 3176 joined by a central web 3178 extending the length of flanges 3176. The web 3178 has a plurality of apertures (not shown) therethrough that are spaced and positioned so as to align with apertures 260 of the longitudinal flanges 254 of the plates 232, for enabling the plates 232 to be secured to the longitudinal reinforcement member 3174. As will be understood, the longitudinal reinforcement member 3174 provides improved distribution of loads throughout the metal archway 3130.

Figure 27A:
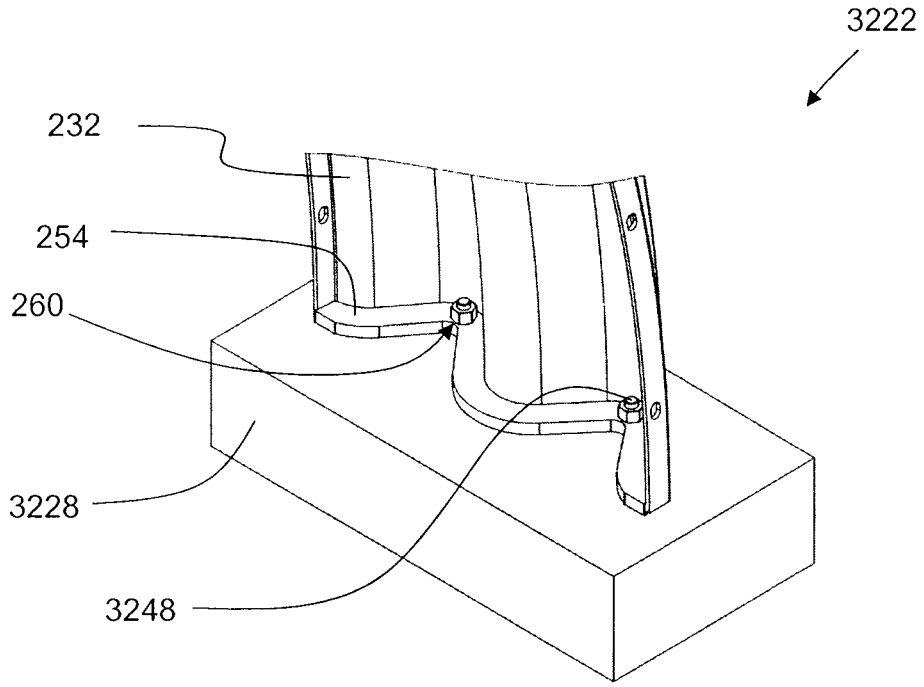
FIGS. 27*a* and 27*b* are perspective and sectional views, respectively, of a footing forming part of another embodiment of an overhead structure.
Figure 27B:
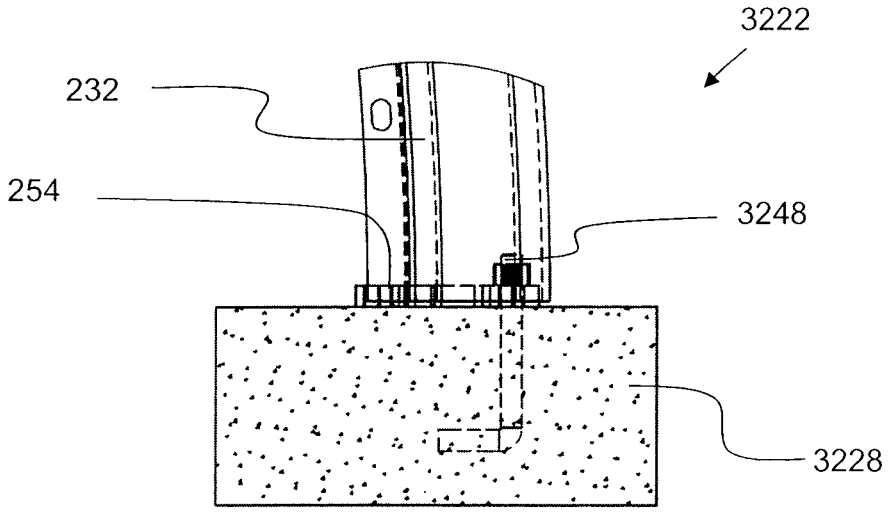

As will be appreciated, the longitudinal flanges of the corrugated metal plates enable the plates to be fastened directly to the concrete footing of the overhead structure, and without requiring use of an intermediate footing channel. For example, FIGS. 27*a* and 27*b* show a portion of another embodiment of an overhead structure 3222, comprising a metal archway constructed from corrugated metal plates 232, and comprising a concrete footing 3228. The concrete footing 3228 comprises a plurality of threaded studs 3248 embedded therein and extending upwardly therefrom. Threaded studs 3248 are sized and positioned to be received in apertures 260 of the longitudinal flanges 254, allowing the plates 232 to advantageously be secured directly to the concrete footing 3228.

Figure 27C:
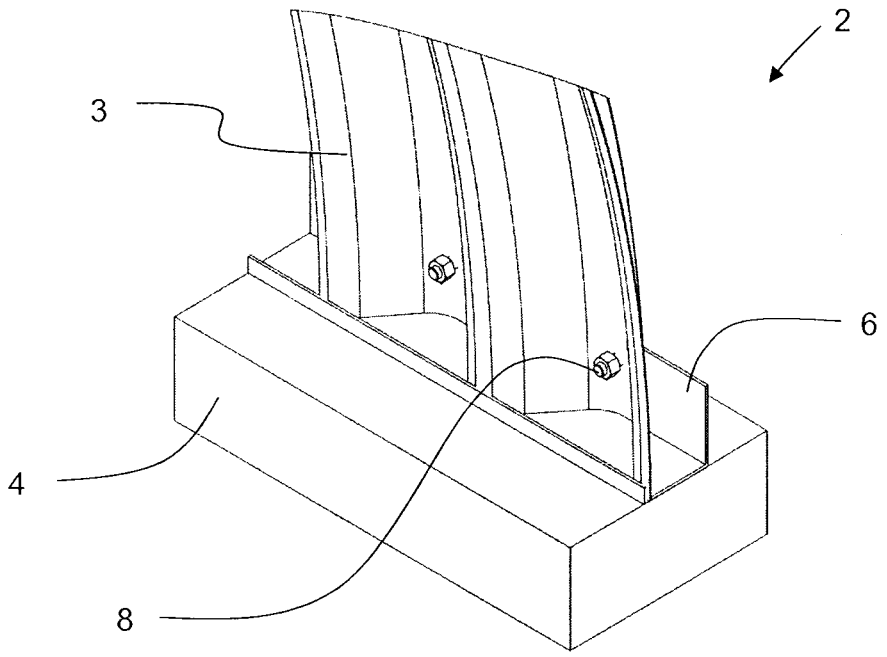
(PRIOR ART) Figure 27c
FIGS. 27*c* and 27*d* are perspective and sectional views, respectively, of a prior art footing forming part of a prior art overhead structure.
Figure 27D:
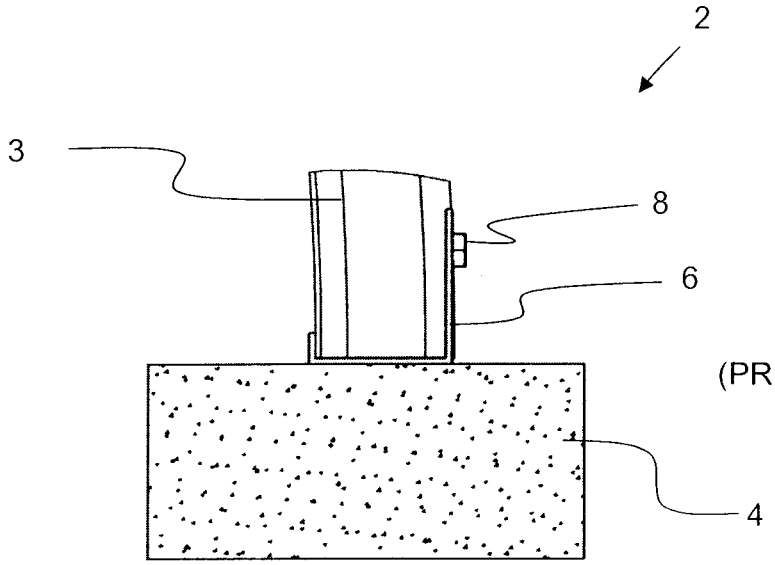
(PRIOR ART) Figure 27d

In contrast, conventional overhead structures constructed from conventional corrugated metal plates typically require a footing channel for securing the plates to the concrete footing. For example, FIGS. 27*c* and 27*d* show a portion of a conventional overhead structure 2 comprising a metal archway constructed from corrugated metal plates 3, and where the plates 3 are conventional plates and do not have circumferential or longitudinal flanges. The overhead structure 2 comprises a concrete footing 4 to which a footing channel 6 is secured. The plates 3 are secured to the footing channel 6 using fasteners 8 which, in the embodiment shown, are bolts. Fasteners 8 are also used for securing adjacent plates 3 (not shown) to each other along the length of the overhead structure 2. As will be understood, such a conventional configuration subjects the fasteners 8 to shear loads, which results in a weaker connection between the plates 3 and the footing 4 of the conventional overhead structure 2.

Figure 28A:
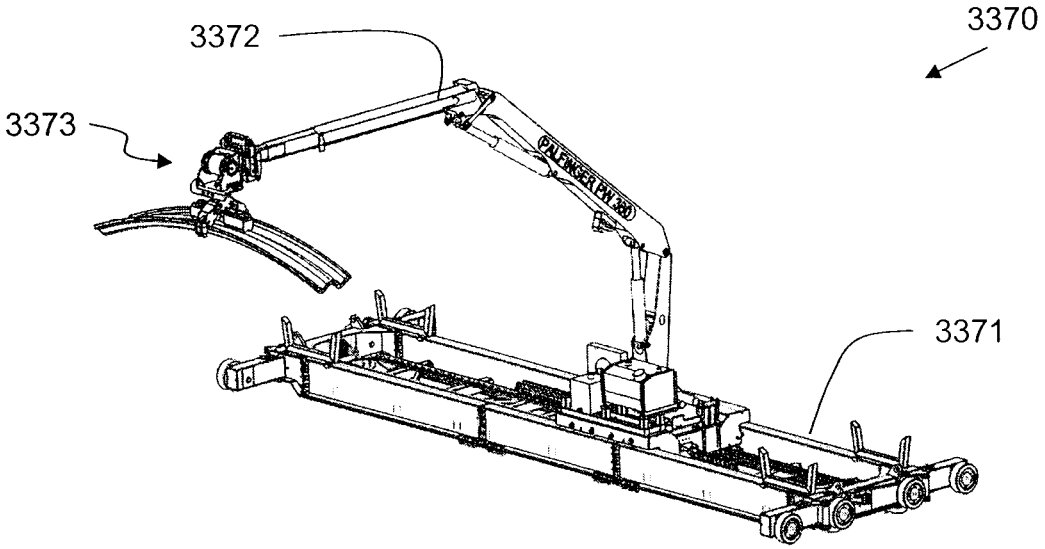
FIGS. 28*a* and 28*b* are perspective views of an automated assembly tool, and a gripper forming part thereof, respectively, for assembling the metal archway of FIG. 2.
Figure 28B:
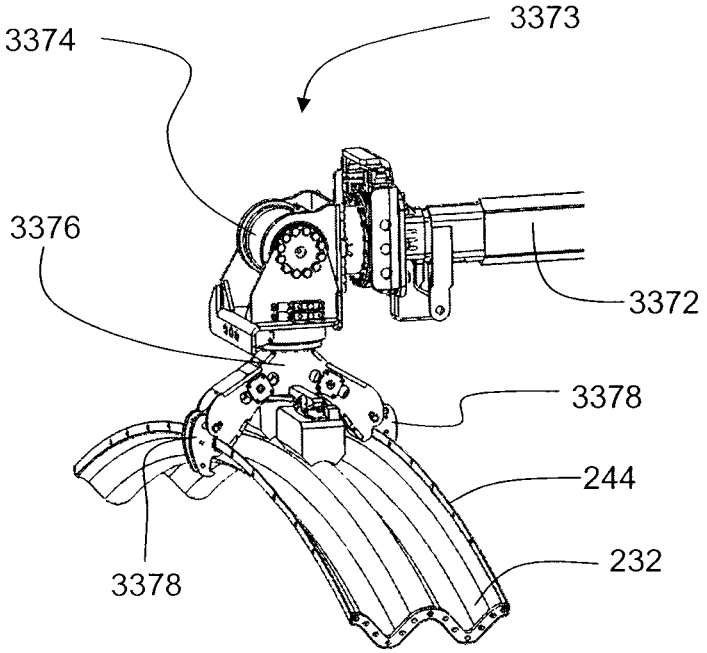
Figure 29:
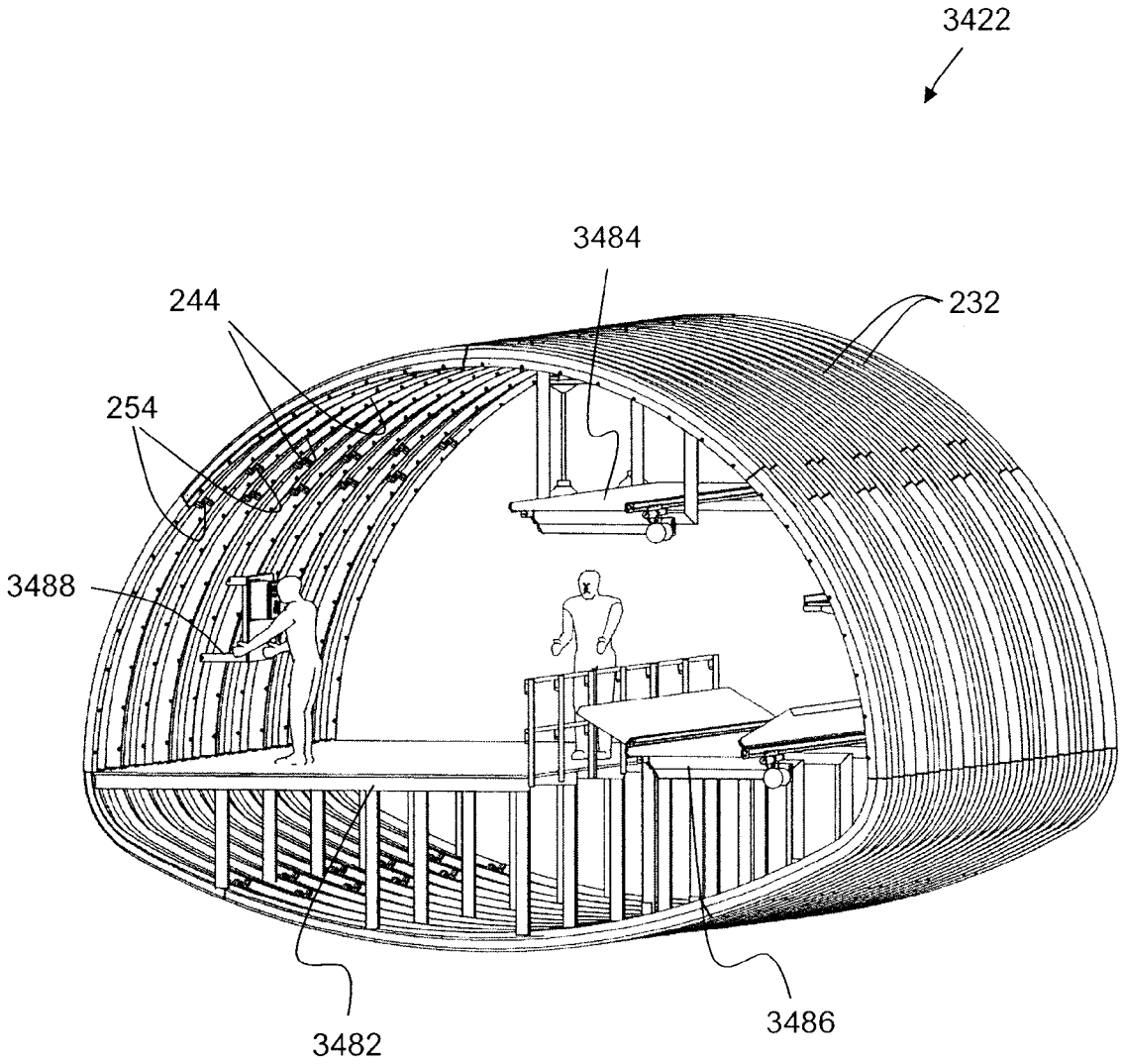
FIG. 29 is a perspective view of a portion of a tunnel lining constructed from the corrugated metal plate of FIG. 6*b*.

As mentioned above, the flanges of the corrugated metal plates enable metal archways or other structures to be readily assembled using robotic or automated assembly equipment. For example, FIGS. 28*a* and 28*b* show an automated assembler, and which is generally indicated by reference numeral 3370. Automated assembler 3370 comprises a moveable trolley 3371 supporting a rotatable, telescoping boom 3372 that supports a gripper unit 3373 at one end thereof. The gripper unit 3373 comprises a universally rotatable joint 3374, and supports a gripper base 3376 having two retractable grippers 3378 that are configured for gripping the circumferential flanges 244 of a corrugated metal plate 232. As will be appreciated, use of the automated assembler 3370 advantageously expedites the assembly process, reduces the amount of skilled labor needed for assembly of the structure.

Other automated assembly equipment, such as an automated fastening unit (not shown) capable of securing individual corrugated metal plates to a partially-constructed metal archway or other structure, may be used in conjunction with the automated assembler 3370. As will be appreciated, such automated assembly equipment may advantageously be used for assembly of structures in hazardous environments that may otherwise pose a safety risk to laborers.

The flanges of the corrugated metal plates also advantageously provide convenient connection surfaces for items inside the curved structure when the plates are oriented such that the flanges are inside the structure. For example, FIG.

29 shows a tunnel lining 3422 that is constructed from a plurality of corrugated metal plates 232. The plates 232 are oriented such that the circumferential flanges 244 and longitudinal flanges 254 are facing the interior of the tunnel lining 3422. As may be seen, the flanges 244 and 254 provide connection surfaces for a sub-floor 3482, a lighting structure 3484, a conveyor structure 3486, and a computer and control structure 3488. Those skilled in the art will appreciate that the circumferential flanges 244 and longitudinal flanges 254 may provide connection surfaces for other structures.

Figure 30:
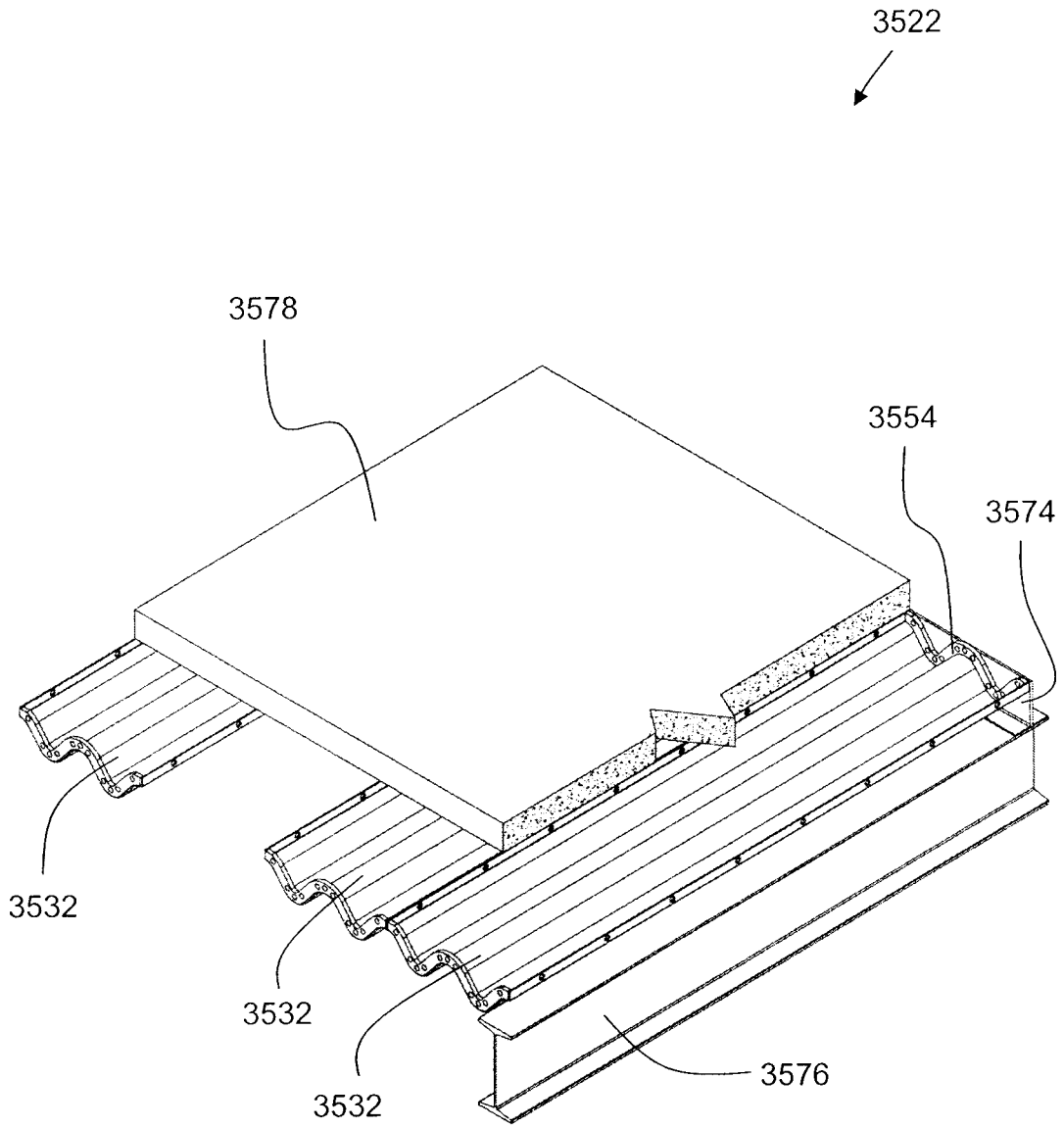
FIG. 30 is a perspective, partial sectional view of a bridge deck fabricated from another embodiment of a corrugated metal plate.

In embodiments described above, the corrugated metal plates are shown as being circumferentially curved, whereby the crests and troughs are curved along their lengths and thereby define a circumferential radius of curvature of the plate. However, as mentioned above, those skilled in the art will understand that the corrugated metal plate may alternatively be generally flat, whereby the lengths of the crests and troughs define generally parallel planes that extend the length of the plate. As will be appreciated, such generally flat plates are well-suited for use in structures comprising generally planar portions, such as bridges. For example, FIG. 30 shows an embodiment of a portion of a bridge deck, and which is generally indicated by reference numeral 3522. Bridge deck 3522 is constructed from a plurality of corrugated metal plates 3532. Each corrugated metal plate 3532 is generally similar to plate 232 described above and with reference to FIG. 6*b*, but is generally flat, whereby the lengths of the crests and troughs define generally parallel planes that extend the length of the plate 3532. In the embodiment shown, the plates 3532 are arranged within a single layer within the bridge deck, such that they are secured along their longitudinal flanges 3544, and such that their transverse flanges 3554 abut first steel beams 3574. Although only one (1) first steel beam 3554 is shown supporting the transverse flanges 3554 at one end of the plates 3532, it will be understood that a similar steel beam supports the longitudinal flanges at the opposite end of the plates 3532. First steel beams 3574 are in turn supported by second steel beams 3576. Again, although only one (1) second steel beam 3556 is shown supporting the first steel beam 3574, it will be understood that similar second steel beam supports these other first steel beams. A bridge deck slab 3578 is positioned on the plates 3532, and provides a surface for traffic of the bridge deck 3522.

As will be appreciated, the corrugated metal plates described above are not limited to use in overhead structures, and in other embodiments, the corrugated metal plates may be used in other structures or for other applications. For example, the corrugated metal plates may be used to form walls of shipping containers, or may be used to form walls or other components of buildings.

As will be understood, the positioning of the apertures of the circumferential flanges and longitudinal flanges is not limited to those shown in the embodiments described above, and in other embodiments, the apertures may alternatively be positioned differently along one or more of the circumferential flanges and longitudinal flanges.

Although embodiments described above are directed to corrugated metal plates, it will be understood by those of skill in the art that the corrugated metal plates may be of a range of thicknesses, and therefore may alternatively be corrugated metal sheets or otherwise.

Although in embodiments described above, the longitudinal flanges follow the contour of the crests and troughs, in other embodiments, the longitudinal flanges may alternatively not follow the contour of the crests and troughs and may alternatively be rectangularly shaped, or otherwise.

Although in embodiments described above, each longitudinal flange is formed by welding the longitudinal flange to the plate, in other embodiments, each longitudinal flange may alternatively be joined to the plate by other suitable joining methods.

Although in embodiments described above, the circumferential flanges are formed by bending the plate along the circumferential edges, in other embodiments, the circumferential flanges may alternatively be formed by joining the circumferential flange to the plate, such as by welding or other suitable joining methods.

Although in embodiments described above, the transverse flanges of the corrugated metal plate comprise alignment features, in other embodiments, the longitudinal flanges of the corrugated metal plate may also, or alternatively, comprise alignment features.

Although in embodiments described above, the corrugated metal plate has a pitch, and namely a spacing between adjacent crests, of about 381 mm, and a depth of about 140 mm, it will be understood that the pitch and the depth are not limited to these values and, in other embodiments, the plate may alternatively have a different pitch and/or a different depth. For example, in other embodiments, the plate may alternatively have a pitch of about 500 mm, a depth of about 237 mm. As another example, in other embodiments, the plate may alternatively have a pitch of about 152.4 mm, a depth of about 50.8 mm.

Although in embodiments described above, the corrugated metal plate comprises longitudinal flanges and transverse flanges, in other embodiments, the corrugated metal plate may alternatively comprise only longitudinal flanges or only transverse flanges.

Although in embodiments described above, each transverse flange extends continuously along the length of the transverse edge, in other embodiments, there may alternatively be two or more transverse flanges that extend along the length of the transverse edge and are separated by one or more gaps. Analogously, although in embodiments described above, each longitudinal flange extends continuously along the length of the longitudinal edge, in other embodiments, there may alternatively be two or more longitudinal flanges that extend along the length of the circumferential edge and are separated by one or more gaps.

Although embodiments have been described, it will be appreciated by those skilled in the art that variations and modifications may be made without departing from the scope thereof as defined by the appended claims.

What is claimed is:

1. A corrugated metal plate for an arch-shaped overhead structure comprising:

a plate member configured to define a series of alternating crests and troughs, the plate member having longitudinal edges extending parallel to longitudinal axes of the crests and the troughs and transverse edges extending orthogonally to the longitudinal axes of the crests and the troughs and having alternating crest and trough contours; and a transverse flange extending along and having a contour following the alternating crest and trough contour of each transverse edge, wherein each of said transverse flanges comprises:

a series of spaced holes formed therein to align with spaced holes formed in a transverse flange of an abutting corrugated metal plate and configured to accommodate fasteners passing through the aligned holes; and at least one alignment feature formed therewith that is offset from said holes and configured to matingly engage at least one complimentary alignment feature of the adjacent abutting corrugated metal plate to facilitate alignment of the spaced holes, wherein at least one of the alignment features of said metal plate is in the form of a forwardly projecting pin or a forwardly extending, longitudinal protrusion and wherein at least another of the alignment features of said metal plate is in the form of a pin-receiving notch or a protrusion-receiving, longitudinal groove.

2. The corrugated metal plate of claim 1, wherein each transverse flange either extends upwardly or downwardly from the transverse edge or wherein each transverse edge, along its length, intersects its respective transverse flange intermediate upper and lower edges of the respective transverse flange to define a first upwardly extending flange portion and a second downwardly extending flange portion.

3. The corrugated metal plate of claim 2, wherein each transverse edge intersects its respective transverse flange midway between the upper and lower edges of the respective transverse flange.

4. The corrugated metal plate of claim 1, further comprising at least one longitudinal flange extending along each longitudinal edge of said plate member, wherein each said at least one longitudinal flange is generally centered on a crest or a trough.

5. The corrugated metal plate of claim 4, wherein crests and troughs of adjacent corrugated metal plates are generally contiguous when the longitudinal flanges of the adjacent corrugated metal plates abut.

6. The corrugated metal plate of claim 4, wherein each said at least one longitudinal flange comprises a plurality of spaced holes provided therein for receiving fasteners.

7. The corrugated metal plate of claim 6, wherein each said at least one longitudinal flange comprises a groove formed in an outwardly facing surface thereof for accommodating a gasket or a quantity of sealant.

8. The corrugated metal plate of claim 6, wherein the at least one longitudinal flange extending along one of said longitudinal edges comprises a longitudinally extending protrusion formed in an outwardly facing surface thereof and wherein the at least one longitudinal flange extending along the other of said longitudinal edges comprises a longitudinally extending groove formed in an outwardly facing surface thereof, said groove sized to accommodate the protrusion of an adjacent corrugated metal plate.

9. The corrugated metal plate of claim 6, wherein each said at least one longitudinal flange comprises a plurality of alignment features integrally formed therewith to matingly engage one or more complimentary features of an adjacent abutting corrugated metal plate.

10. The corrugated metal plate of claim 6, comprising a single longitudinal flange extending generally the length of each said longitudinal edge.

11. The corrugated metal plate of claim 1, wherein said corrugated metal plate is curved in at least one of a longitudinal direction and a transverse direction.

12. The corrugated metal plate of claim 1, further comprising gussets adjoining each transverse flange to the plate member.

13. The corrugated metal plate of claim 1, wherein the transverse flange extending along one of said transverse edges comprises a longitudinally extending protrusion formed in an outwardly facing surface thereof and wherein the transverse flange extending along the other of said transverse edges comprises a longitudinally extending groove formed in an outwardly facing surface thereof, said groove sized to accommodate the protrusion of an adjacent corrugated metal plate.

14. The corrugated metal plate of claim 13, wherein the groove is further sized to accommodate a gasket or a quantity of sealant.

15. The corrugated metal plate of claim 1, wherein each of said transverse flanges comprises spaced alignment features in the form of at least one pin and at least one notch.

16. The corrugated metal plate of claim 1, further comprising one or more transverse stiffener flanges intermediate the transverse edges of said plate and extending between the longitudinal edges of said plate member.

17. An arch-shaped overhead structure comprising:

a curved metal archway, said metal archway comprising a plurality of corrugated metal plates connected end-to-end and side-by-side and arranged to define corrugations extending transversely of a longitudinal length of said metal archway, each of said corrugated metal plates comprising:

a plate member configured to define a series of alternating crests and troughs, the plate member having longitudinal edges extending parallel to longitudinal axes of the crests and the troughs and transverse edges extending orthogonally to the longitudinal axes of the crests and the troughs;

a transverse flange extending along each transverse edge, the transverse flanges of adjacent end-to-end connected corrugated metal plates being in abutting face-to-face engagement and being secured to each other via first fasteners passing through aligned holes in the transverse flanges; and longitudinal flanges extending along each longitudinal edge, the longitudinal flanges of adjacent side-by-side connected corrugated plates being in abutting face-to-face engagement and being secured to each other via second fasteners passing through aligned holes in said longitudinal flanges, wherein the transverse flanges and/or the longitudinal flanges comprise mating alignment features formed therewith that are offset from said aligned holes and that facilitate alignment of the spaced holes, and wherein at least one of the alignment features is in the form of a forwardly projecting pin or a forwardly extending, longitudinal protrusion and wherein at least another of the alignment features is in the form of a pin-receiving notch or a protrusion-receiving, longitudinal groove.

18. The overhead structure of claim 17, wherein the corrugated metal plates are arranged in two layers so as to form a double layer of corrugated metal plates.

19. The overhead structure of claim 18, wherein the corrugated metal plates forming the double layer define at least on interior cavity configured to be filled with concrete.

20. The overhead structure of claim 19, further comprising a plurality of shear studs attached to the corrugated metal plates within at least one of the cavities for providing a shear bond at the metal-concrete interface.

21. The overhead structure of claim 18, wherein the corrugated metal plates forming an inner layer are separated from the corrugated metal plates forming an outer layer by spacer plates.

22. The overhead structure of claim 21, wherein the corrugated metal plates forming the double layer and the spacer plates define at least one interior cavity configured to be filled with concrete.

23. The overhead structure of claim 22, further comprising a plurality of shear studs attached to one or more of the corrugated metal plates and the spacer plates within at least one of the cavities for providing a shear bond at the metal-concrete interface.

24. The overhead structure of claim 17, further comprising at least one reinforcement member positioned between adjacent corrugated metal plates.

25. The overhead structure of claim 24, wherein said at least one reinforcement member comprises one or more of a reinforcement rib, a reinforcement beam, a hollow structural section reinforcement rib, and a boxed reinforcement rib.

26. A corrugated metal plate for an arch-shaped overhead structure comprising a plate member configured to define a series of alternating crests and troughs, the plate member having longitudinal edges extending parallel to longitudinal axes of the crests and the troughs and transverse edges extending orthogonally to the longitudinal axes of the crests and the troughs, a first flange extending along one of said transverse edges and a second flange extending along the other of said transverse edges, said first and second flanges presenting outwardly facing planar surfaces to abut flanges of adjacent corrugated metal plates, each of said first and second flanges having at least one alignment feature formed therewith to mate with at least one complimentary alignment feature of an adjacent corrugated metal plate and each of said first and second flanges also having longitudinally spaced holes formed therein that are spaced and offset from said at least one alignment feature, said longitudinally spaced holes aligning with corresponding holes of an adjacent corrugated metal plate when the at least one alignment feature is brought into mating engagement with the at least one complimentary alignment feature of the adjacent corrugated metal plate to facilitate passage of fasteners through the aligned holes, at least one of said alignment features of the metal plate being in the form of a forwardly extending, longitudinal protrusion or a forwardly extending pin and at least one of said alignment features of the metal plate being in the form of a protrusion-receiving, longitudinal groove or a pin-receiving notch.

27. The corrugated metal plate of claim 26, further comprising a third flange extending along one of said longitudinal edges and a fourth flange extending along the other of said longitudinal edges, said third and fourth flanges having alignment features formed therewith to mate with complimentary alignment features of adjacent corrugated metal plates, at least one of said alignment features being in the form of a forwardly extending, longitudinal protrusion or a forwardly extending pin and at least one of said alignment features being in the form of a protrusion-receiving, longitudinal groove or a pin-receiving notch.

28. The corrugated metal plate of claim 27, wherein the at least one alignment feature formed with each of said first and second flanges comprises a plurality of spaced alignment features in the form of at least one pin and at least one notch.

29. The corrugated metal plate of claim 26, wherein the at least one alignment feature formed with each of said first and second flanges comprises spaced alignment features in the form of at least one pin and at least one notch.

30. The corrugated metal plate of claim 26, wherein the at least one alignment feature formed with one of said first and second flanges comprises the forwardly extending, longitudinal protrusion and wherein the at least one alignment feature formed with the other of said first and second flanges comprises the protrusion-receiving, longitudinal groove.

31. A corrugated metal plate for an arch-shaped overhead structure comprising a plate member configured to define a series of alternating crests and troughs, the plate member having longitudinal edges extending parallel to longitudinal axes of the crests and the troughs and transverse edges extending orthogonally to the longitudinal axes of the crests and the troughs, a first flange extending along one of said longitudinal edges and a second flange extending along the other of said longitudinal edges, said first and second flanges presenting outwardly facing planar surfaces to abut flanges of adjacent corrugated metal plates, each of said first and second flanges having at least one alignment feature formed therewith to mate with at least one complimentary alignment feature of an adjacent corrugated metal plate and each of said first and second flanges also having longitudinally spaced holes formed therein that are spaced and offset from said at least one alignment feature, said longitudinally spaced holes aligning with corresponding holes of an adjacent corrugated metal plate when the at least one alignment feature is brought into mating engagement with the at least one complimentary alignment feature of the adjacent corrugated metal plate to facilitate passage of fasteners through the aligned holes, at least one of said alignment features of the metal plate being in the form of a forwardly extending, longitudinal protrusion or a forwardly extending pin and at least one of said alignment features of the metal plate being in the form of a protrusion-receiving, longitudinal groove or a pin-receiving notch.

32. The corrugated metal plate of claim 31, wherein the at least one alignment feature formed with each of said first and second flanges comprises spaced alignment features in the form of at least one pin and at least one notch.

33. The corrugated metal plate of claim 31, wherein the at least one alignment feature formed with one of said first and second flanges comprises the forwardly extending, longitudinal protrusion and wherein the at least one alignment feature formed with the other of said first and second flanges comprises the protrusion-receiving, longitudinal groove.

* * * * *